US005572799A

United States Patent [19]

Masuyuki et al.

[11] Patent Number: 5,572,799

[45] Date of Patent: Nov. 12, 1996

[54] VENTILATOR/DRYER ASSEMBLY FOR ADSORBING WET AIR IN A ROOM

[75] Inventors: Hashimoto Masuyuki; Nakayama Toshio, both of Gunma-ken; Namatame Tatuo, Ashikaga; Kunio Kayama, Ohta, all of Japan

[73] Assignee: Sanyo Electric Co., Ltd., Osaka, Japan

[21] Appl. No.: 447,675

[22] Filed: May 23, 1995

[30] Foreign Application Priority Data

Jul. 22, 1994 [JP] Japan ..... 6-171417
Nov. 25, 1994 [JP] Japan ..... 6-291263

[51] Int. Cl.[6] ..... F26B 21/06

[52] U.S. Cl. ..... 34/80; 34/86; 95/10; 96/125; 62/94

[58] Field of Search ..... 34/629, 72, 73, 34/75, 76, 80, 95, 86; 62/93, 94, 271, 272; 95/10; 96/125, 143, 146, 147; 165/5, 8

[56] References Cited

U.S. PATENT DOCUMENTS

| | | | |
|---|---|---|---|
| 4,668,249 | 5/1987 | Purdue | 96/125 |
| 4,926,618 | 5/1990 | Ratliff | 95/10 |
| 5,147,420 | 9/1992 | Claesson | 96/125 |
| 5,183,098 | 2/1993 | Chagnot | 165/8 |
| 5,230,466 | 7/1993 | Moriya et al. | 62/94 |
| 5,373,704 | 12/1994 | McFadden | 62/94 |

FOREIGN PATENT DOCUMENTS

| | | | |
|---|---|---|---|
| 203331 | 11/1993 | Japan | 62/94 |

*Primary Examiner*—John M. Sollecito
*Assistant Examiner*—Steve Gravin
*Attorney, Agent, or Firm*—Darby & Darby, P.C.

[57] ABSTRACT

A ventilator/dryer device for drying wet air in a room, the device having a treatment chamber, a rotary drying device and a forced circulation mechanism housed in a case main body provided with an air inlet port and an air outlet port that communicate with the interior of the room. The treatment chamber is divided into a primary side section and a secondary side section with the rotary drying device disposed therebetween. The forced circulation mechanism draws air from the room via the air inlet port to the primary side section of the treatment chamber, passes it through the rotary drying device and sends it back into the room through the secondary side section of the treatment chamber and the air outlet port by means of a single blower. The rotary drying device is adapted to take a drying position, a regenerating position and a heat recovering position sequentially in the sense of its rotation. The device adsorbs moisture from the air passing therethrough from the primary side section of the treatment chamber in the drying position, hot air is made to pass through the device in the regenerating position to remove moisture adsorbed by the device in said drying position, and cooled air is made to pass through the heated device in the heat recovering position to cool the device heated in said regenerating position.

8 Claims, 31 Drawing Sheets

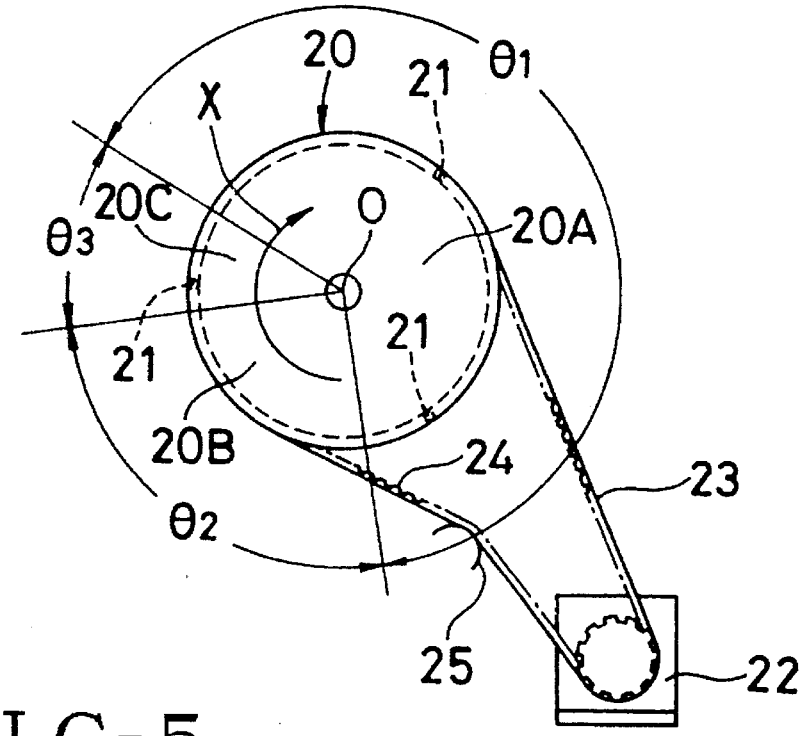
FIG-5
FIG-6
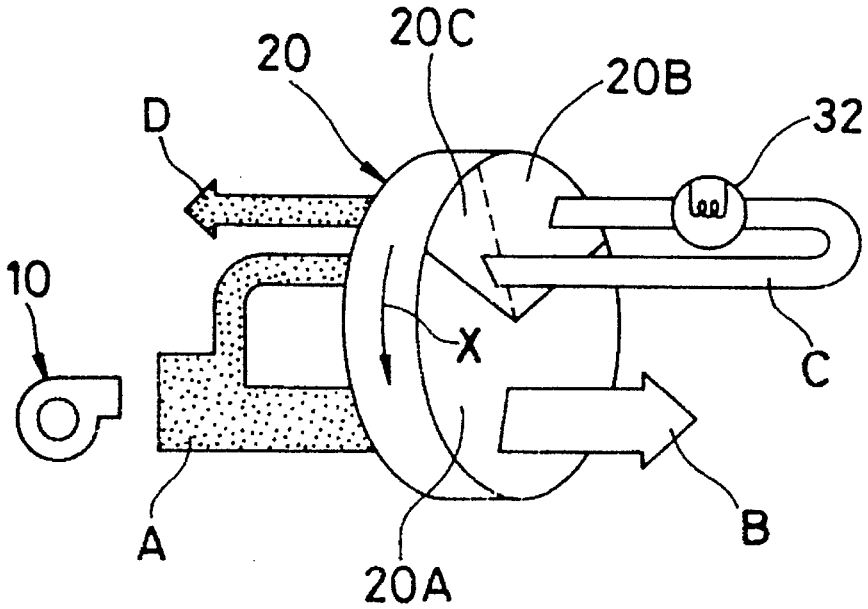

FIG-41
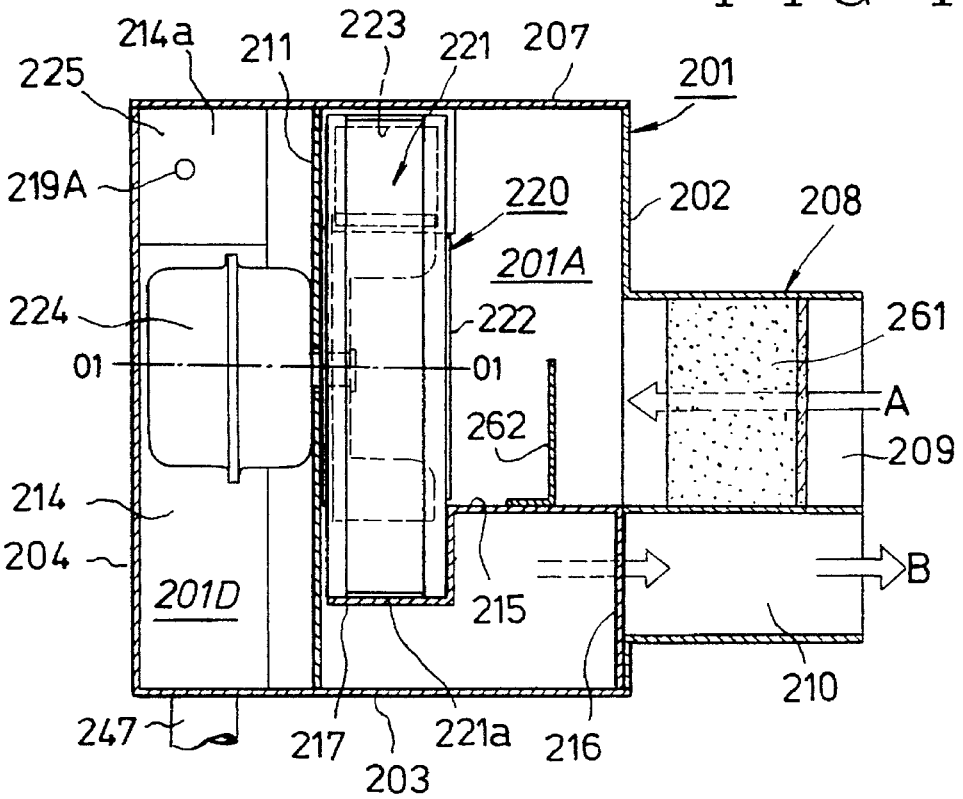
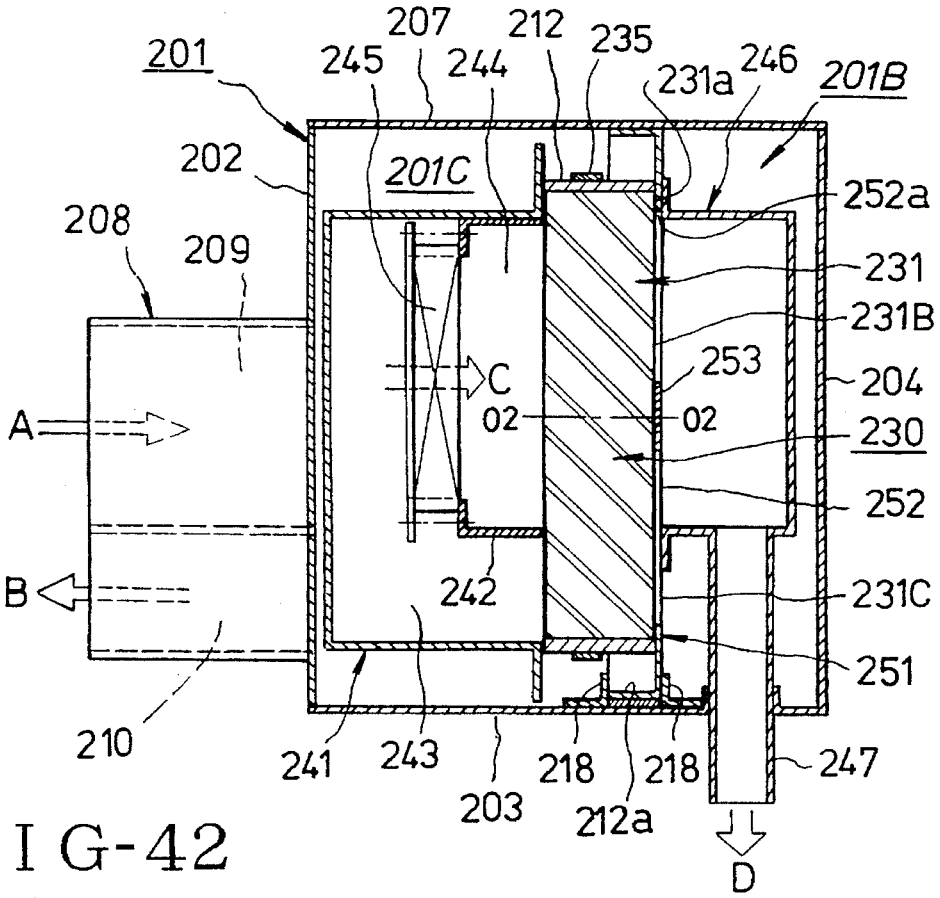
FIG-42

VENTILATOR/DRYER ASSEMBLY FOR ADSORBING WET AIR IN A ROOM

BACKGROUND OF THE INVENTION

1. Field of the Invention

This invention relates to a ventilator/dryer assembly provided with a rotary drying device and a simple blower that can suitably be used for drying the inside of a highly humid and closed room such as a bathroom, a closet, a toilet room, a changing room, a cellar or the like in a building as it allows efficient regeneration of the rotary drying element.

2. Background Art

It is a common practice to provide a wet room in a house such as a bathroom with a vent arranged on the wall or the ceiling and fitted with a grille on the inside and a ventilating fan on the outside within the frame of the vent.

Alternatively, a wet room may be provided with an air outlet port and an air inlet port separately arranged on the wall or the ceiling so that wet air in the room is drawn out through the air outlet port by means of a ventilator/dryer assembly arranged outside the room for drying while dried air is blown into the room through the air inlet port. This arrangement is particularly effective for a bathroom or a laundry where washed wet cloths are hung for drying.

A conventional ventilator/dryer assembly of the type under consideration typically comprises a rotary drying device housed in a case main body and a forced circulation mechanism that circulates air by drawing wet air from the room via the air outlet port, passing it through the rotary drying device for drying by adsorption of moisture and then blowing dried air back into the room via the air inlet port and, at the same time, feeds the moisture containing rotary drying device with hot air in order to regenerate the drying device by removing out of it.

A conventional ventilator/dryer assembly as described above requires two blowers for operation, one dedicated to the forced circulation mechanism for drawing wet air from and blowing dried air back into the room and the other dedicated to feeding air to and discharging air out of the rotary drying device in order to regenerate it. With such a complicated air feeding system, the overall cost of the entire ventilator/dryer assembly would be inevitably high.

Additionally, when air directly taken from the outside is used for regenerating the rotary drying device, such air is hardly controllable in terms of temperature and humidity if heated by means of a heater because it is subject to remarkable changes in temperature and humidity throughout the year. If air is polluted to a significant extent, it can adversely affect the drying performance and the durability of the rotary drying device with time as the latter is gradually smeared with the former.

In view of these circumstances, it is therefore the object of the invention to provide a ventilator/dryer assembly comprising a rotary drying device that operates for drying wet air in a room with a simple air feeding system and can be efficiently regenerated for operation. With such a ventilator/dryer assembly, the size and the cost of the entire assembly is significantly reduced and the operation of drying air in the room is carried out in a remarkably simplified manner.

SUMMARY OF THE INVENTION

According to a first aspect of the invention, the above object is achieved by providing a ventilator/dryer assembly for drying wet air comprising a treatment chamber, a rotary drying device and a forced circulation mechanism housed in a case main body provided with an air inlet port and an air outlet port exposed to the outside, characterized in that the treatment chamber is divided into a primary side section and a secondary side section with the rotary drying device disposed therebetween, that the forced circulation mechanism draws air from the room where the ventilator/dryer assembly is installed via said air inlet port to the primary side section of the treatment chamber, passes it through the rotary drying device and sends it back into the room through the secondary side section of the treatment chamber and the air outlet port by means of a single blower and that the rotary drying device is adapted to take a drying position, a regenerating position and a heat recovering position sequentially in the sense of rotation, the device adsorbing moisture from the air passing therethrough from the primary side section of the treatment chamber in the drying position, hot air being made to pass through the device in the regenerating position to remove moisture adsorbed by the device in said drying position, cooled air being made to pass through the heated device in the heat recovering position to cool the device heated in said regenerating position.

According to a second aspect of the invention, air fed to the rotary drying device in said drying position and air fed to the device in said regenerating position are oppositely directed in a ventilator/dryer assembly as defined above by referring to the first aspect of the invention.

According to a third aspect of the invention, a guide path is provided in said case main body to guide air drawn from the room through the air inlet port to the primary side section of the treatment chamber and a damper is provided downstream to the guide path to discharge wet air directly out of said case main body without passing it through said treatment chamber in a ventilator/dryer assembly as defined above by referring to the first aspect of the invention.

According to a fourth aspect of the invention, a regenerating shell is arranged in the secondary side section of said treatment chamber and provided with heating means for heating air collected from said heat recovering position in order to apply heated air to the rotary drying device in the regenerating position and an air discharging shell is arranged in the primary side section of said treatment chamber as an air discharging mechanism for discharging hot air out of said case main body collected from said regenerating position, said regenerating shell and said air discharging shell being disposed vis-a-vis with said rotary drying device located therebetween, in a ventilator/dryer assembly as defined above by referring to the first aspect of the invention.

According to a fifth aspect of the invention, a lead-in path for a branched air flow coming from the heat recovering position of said rotary drying device and a lead-out path for turning the branched air flow round toward the regenerating position are formed in said regenerating shell and separated from each other by a partition and an electric heater is arranged at the junction of the lead-in path and the lead-out path, the blowing and heating side of the electric heater being disposed vis-a-vis the regenerating position of said rotary drying device, in a ventilator/dryer assembly as defined above by referring to the fourth aspect of the invention.

According to a sixth aspect of the invention, there is provided a ventilator/dryer assembly comprising a cylindrical rotary drying device rotatable around a round shaft arranged in such a way that air may flow in parallel with said shaft, characterized in that the rotary drying device is adapted to take a drying position, a regenerating position and a heat recovering position arranged sequentially in the sense of rotation, the device adsorbing moisture from the air passing therethrough, hot air being made to pass through the device in the regenerating position to remove moisture adsorbed by the device in said drying position, cooled air being made to pass through the heated device in the heat recovering position to cool the device heated in said regenerating position.

According to a seventh aspect of the invention, the surface area of the rotary drying device adapted for an air flow in said drying position is equal to or greater than the surface area of the rotary drying device adapted for an air flow in said regenerating position and the surface area of the rotary drying device adapted for an air flow in said heat recovering position is equal to or smaller than the surface area of the rotary drying device adapted for an air flow in said regenerating position in a ventilator/dryer assembly as defined above by referring to any of the first through the sixth aspects of the invention.

According to an eighth aspect of the invention, the air flow to be applied to the rotary drying device in said heat recovering position is obtained by branching the air flow to be applied to the device in said drying position and the air flow to be applied to the rotary drying device in said regenerating position is obtained by additionally heating the air flow applied to the device in said heat recovering position in a ventilator/dryer assembly as defined above by referring to any of the first through the seventh aspects of the invention.

According to a ninth aspect of the invention, there is provided a ventilator/dryer assembly for drying wet air comprising a treatment chamber, a rotary drying device and a forced circulation mechanism housed in a case main body provided with an air inlet port and an air outlet port exposed to the outside, characterized in that it further comprises a drying mechanism for drying wet air taken in by the forced circulation mechanism through said air inlet port, a regenerating mechanism for removing moisture out the rotary drying device and an air discharging mechanism for directly discharging air taken in through the air inlet port.

According to a tenth aspect of the invention, an operation control mechanism is provided for causing the air discharging mechanism to directly discharge air taken in by said forced circulation mechanism before applying it to said rotary drying device, until the relative humidity in ambient air is reduced to a predetermined level or for a predetermined period of time before applying it to said rotary drying device in a ventilator/dryer assembly as defined above by referring to either the fourth or the ninth aspect of the invention.

According to a still another aspect of the invention, there is provided a ventilator/dryer assembly for drying wet air comprising a rotary drying device and a forced circulation mechanism housed in a case main body provided with an air inlet port and an air outlet port exposed to the outside, characterized in that said case main body is divided at least into a primary zone held in communication with said air inlet port, a tertiary zone held in communication with said air outlet port and a secondary zone arranged adjacent to said primary and tertiary zone and said ventilator/dryer assembly further comprises a blower unit comprising a centrifugal type blower for circulating air from said air inlet port sequentially through said primary, secondary and tertiary zones to said air outlet port and said rotary drying device is arranged between said secondary and tertiary zones to adsorb moisture out of air brought to contact with it, the rotary shaft of said blower unit and that of said rotary drying device being arranged on a same horizontal plane relative to the side of said case main body for interacting with the outside.

According to a further aspect of the invention, said case main body is further divided to form a quaternary zone arranged adjacent to said primary and secondary zone with said air inlet port of the blower of said blower unit facing said primary zone with the drive motor of said blower disposed in said quaternary zone and a cooling path is provided to for directing part of air blown out of said primary zone toward said secondary zone to said quaternary zone and then discharging into the primary zone in a ventilator/dryer assembly as defined above by referring to the preceding aspect of the invention.

According to a still further aspect of the invention, said primary zone and said secondary zone are separated by a partition panel and said secondary and zone and said tertiary zone are separated by another partition panel, said blower unit being fitted to said partition panel separating said primary and secondary zones, said rotary drying device being fitted to said partition panel separating said secondary and tertiary zones, said blower unit and said rotary drying device being realized in the form of removable units combined with the respective partition panels in a ventilator/dryer assembly as defined above by referring to the preceding aspect of the invention.

Thus, with a ventilator/dryer assembly for drying wet air comprising a treatment chamber, a rotary drying device and a forced circulation mechanism housed in a case main body provided with an air inlet port and an air outlet port exposed to the outside as described above by referring to the first aspect of the invention, the operation of drying the inside of the room where it is installed by means of the rotary drying device of the ventilator/dryer assembly and that of regenerating the rotary drying device can be carried out concurrently at all times because the ventilator/dryer assembly is characterized in that the treatment chamber is divided into a primary side section and a secondary side section with the rotary drying device disposed therebetween, that the forced circulation mechanism draws air from the room where the ventilator/dryer assembly is installed via said air inlet port to the primary side section of the treatment chamber, passes it through the rotary drying device and sends it back into the room through the secondary side section of the treatment chamber and the air outlet port by means of a single blower and that the rotary drying device is adapted to take a drying position, a regenerating position and a heat recovering position arranged sequentially in the sense of rotation, the device adsorbing moisture from the air passing therethrough from the primary side section of the treatment chamber in the drying position, hot air being made to pass through the device in the regenerating position to remove moisture adsorbed by the device in said drying position, cooled air being made to pass through the heated device in the heat recovering position to cool the device heated in said regenerating position.

Additionally, since the forced circulation mechanism of the ventilator/dryer assembly comprises a single blower which may typically be a sirocco fan that draws and discharges air both for air circulation in the room and for regeneration of the rotary drying device, the overall configuration of the ventilation system of the room can be simplified for downsizing.

Still additionally, if air to be applied to the heat recovering position is obtained by branching the air flow directed to the drying position and air used in the heat recovering position is heated and used again in the regenerating position in the ventilator/dryer assembly, air can be heated efficiently for the purpose of regenerating the rotary drying device so that a relatively low capacity heater may be used for the ventilator/dryer assembly.

When air fed to the rotary drying device in said drying position and air fed to the device in said regenerating position are oppositely directed in a ventilator/dryer assembly according to the invention as described above by referring to the second aspect of the invention, the rotary drying device can be cleaned automatically.

When a guide path is provided in said case main body to guide air drawn from the room through the air inlet port to the primary side section of the treatment chamber and a damper is provided downstream to the guide path to discharge wet air directly out of said case main body without passing it through said treatment chamber in a ventilator/dryer assembly according to the invention as described above by referring to the third aspect of the invention, the operation of ventilating the room and that of drying it can be carried out independently and sequentially to improve the efficiency of drying the room and consequently reduce the time required for drying washed cloths.

If a regenerating shell is arranged in the secondary side section of said treatment chamber and provided with heating means for heating air collected from said heat recovering position in order to apply heated air to the rotary drying device in the regenerating position and an air discharging shell is arranged in the primary side section of said treatment chamber as an air discharging mechanism for discharging hot air out of said case main body collected from said regenerating position, said regenerating shell and said air discharging shell being disposed vis-a-vis with said rotary drying device located therebetween, in a ventilator/dryer assembly according to the invention as described above by referring to the fourth aspect of the invention, hot air to be discharged from the ventilator/dryer assembly is prevented from being fed again to the rotary drying device and therefore the moisture adhering to the rotary drying device can be efficiently removed. Consequently, the entire room where the ventilator/dryer assembly is installed can be dried effectively and efficiently.

If a lead-in path for a branched air flow coming from the heat recovering position of said rotary drying device and a lead-out path for turning the branched air flow round toward the regenerating position are formed in said regenerating shell and separated from each other by a partition and an electric heater is arranged at the junction of the lead-in path and the lead-out path, the blowing and heating side of the electric heater being disposed vis-a-vis the regenerating position of said rotary drying device, in a ventilator/dryer assembly according to the invention as described above by referring to the fifth aspect of the invention, the width of the regenerating shell can be reduced and consequently the entire ventilator/dryer assembly may be significantly downsized.

With a ventilator/dryer assembly for drying wet air comprising a treatment chamber, a rotary drying device and a forced circulation mechanism housed in a case main body provided with an air inlet port and an air outlet port exposed to the outside as described above by referring to the ninth aspect of the invention, the operation of drying the inside of the room where it is installed can be carried out efficiently to significantly reduce the rate of consuming energy and consequently the time required for drying washed cloths can be greatly reduced because it further comprises an air discharging mechanism for directly discharging air in the room and therefore air can be selectively forced out of the room before it is caused to pass through the rotary drying device by means of the forced circulation mechanism.

If an operation control mechanism is provided for causing the air discharging mechanism to directly discharge air taken in by said forced circulation mechanism before applying it to said rotary drying device, until the relative humidity in ambient air is reduced to a predetermined level or for a predetermined period of time before applying it to said rotary drying device in a ventilator/dryer assembly according to the invention as described above by referring to the ninth aspect of the invention, the operation of ventilating and/or drying the inside of the room can be carried out more efficiently.

With a ventilator/dryer assembly for drying wet air comprising a rotary drying device and a forced circulation mechanism housed in a case main body provided with an air inlet port and an air outlet port exposed to the outside as described above and characterized in that said case main body is divided at least into a primary zone held in communication with said air inlet port, a tertiary zone held in communication with said air outlet port and a secondary zone arranged adjacent to said primary and tertiary zone and said ventilator/dryer assembly further comprises a blower unit comprising a centrifugal type blower for circulating air from said air inlet port sequentially through said primary, secondary and tertiary zones to said air outlet port and said rotary drying device is arranged between said secondary and tertiary zones to adsorb moisture out of air brought to contact with it form a specifically designed air flow path, the overall configuration of the ventilation system of the room can be further simplified for downsizing.

If said case main body is further divided to form a quaternary zone arranged adjacent to said primary and secondary zone with said air inlet port of the blower of said blower unit facing said primary zone with the drive motor of said blower disposed in said quaternary zone and a cooling path is provided to for directing part of air blown out of said primary zone toward said secondary zone to said quaternary zone and then discharging into the primary zone in a ventilator/dryer assembly as according to the invention and described above by referring to the preceding aspect of the invention, the blower unit can be effectively and efficiently cooled while the ventilator/dryer assembly is in operation.

If said blower unit and said rotary drying device are arranged in juxtaposition in such a way that their rotary shafts are found on a same horizontal plane relative to the side of said case main body for interacting with the inside of the room in a ventilator/dryer assembly according to the invention as described above by referring to the preceding aspect of the invention, the width of the case main body of the ventilator/dryer assembly as viewed from the side thereof for interacting with the inside of the room can be significantly reduced.

If, finally, said primary zone and said secondary zone and said secondary and zone and said tertiary zone are separated by respective partition panels, said blower unit being fitted to said partition panel separating said primary and secondary zones, said rotary drying device being fitted to said partition panel separating said secondary and tertiary zones, said blower unit and said rotary drying device being realized in the form of removable units combined with the respective partition panels in a ventilator/dryer assembly according to the invention as described above by referring to the preceding aspect of the invention, both the blower unit and the rotary drying device can be fitted to and removed from the case main body with ease and held stably in position so that the entire ventilator/dryer assembly can be serviced without difficulty.

Now, the present invention will be described in greater detail by referring to the accompanying drawings that illustrate, not limitatively, preferred embodiment of the invention.

BRIEF DESCRIPTION OF THE DRAWINGS

FIG. 5 is a schematic frontal view of the rotary drying device of a ventilator/dryer assembly according to the invention.

FIG. 6 is a schematic illustration conceptually showing the drying/circulating operation of the rotary drying device and the operation of regenerating the rotary drying device by feeding it with regenerative air in a ventilator/dryer assembly according to the invention.

FIG. 41 is a schematic longitudinal cross sectional view of the embodiment of FIG. 39 taken along line I—I in FIG. 40.

FIG. 42 is a schematic longitudinal cross sectional view of the embodiment of FIG. 39 taken along line II—II in FIG. 40.

DETAILED DESCRIPTION OF THE PREFERRED EMBODIMENTS

Figure 1:
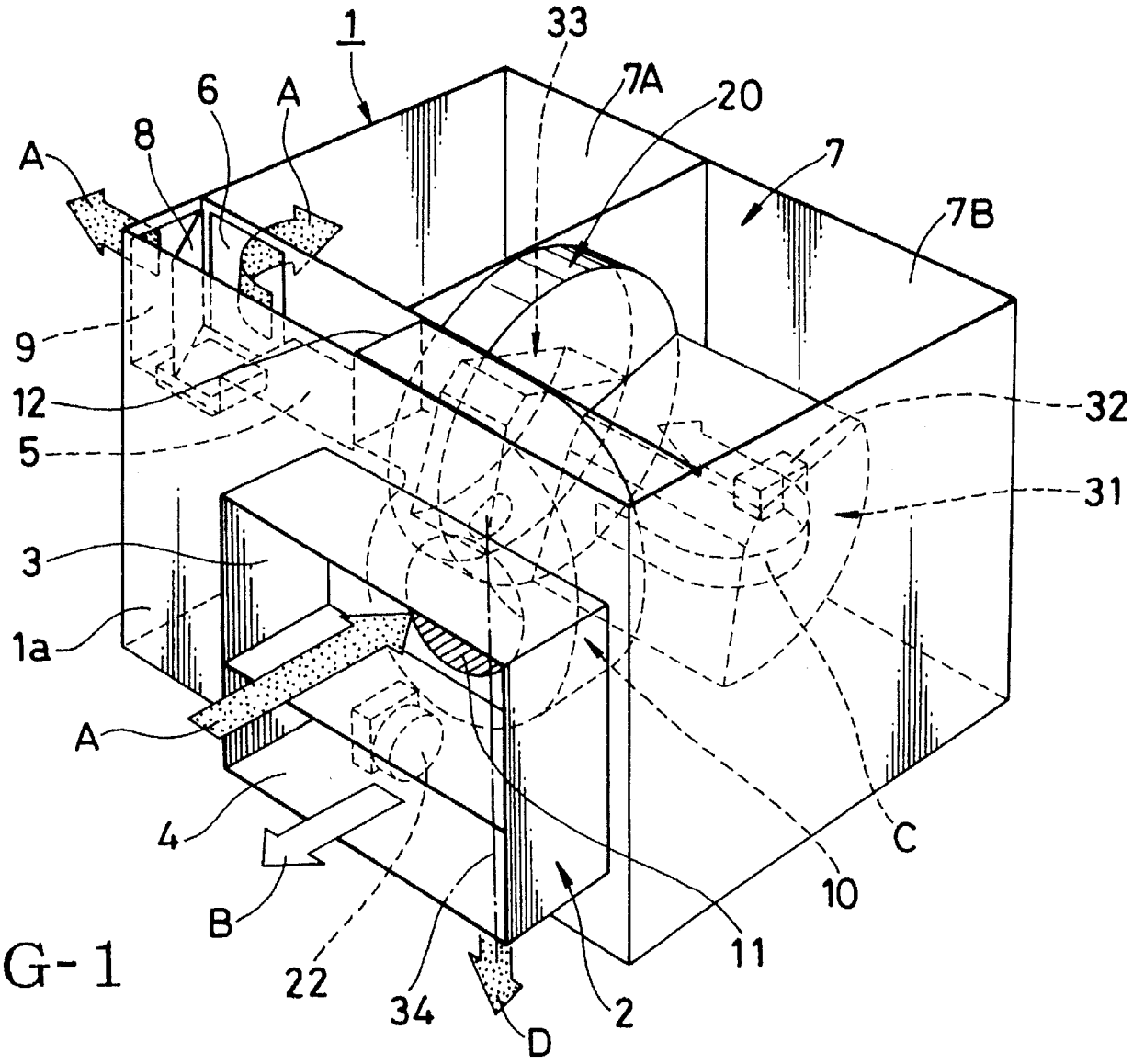
FIG. 1 is a schematic perspective view of a preferred embodiment of ventilator/dryer assembly according to the invention.

Referring firstly to FIG. 1, schematically showing a preferred embodiment of the invention, it comprises a case main body 1 having a front panel 1*a* provided with a rectangularly parallelepipedic joint section 2 typically having a height and a width of 150 mm×200 mm and projecting from the front panel 1*a*. An air inlet port 3 and an air outlet port 4 are arranged vertically side by side within the joint section 2 so that air can be drawn in and blown out through a single limited area on a single side of the case main body 1.

Figure 2:
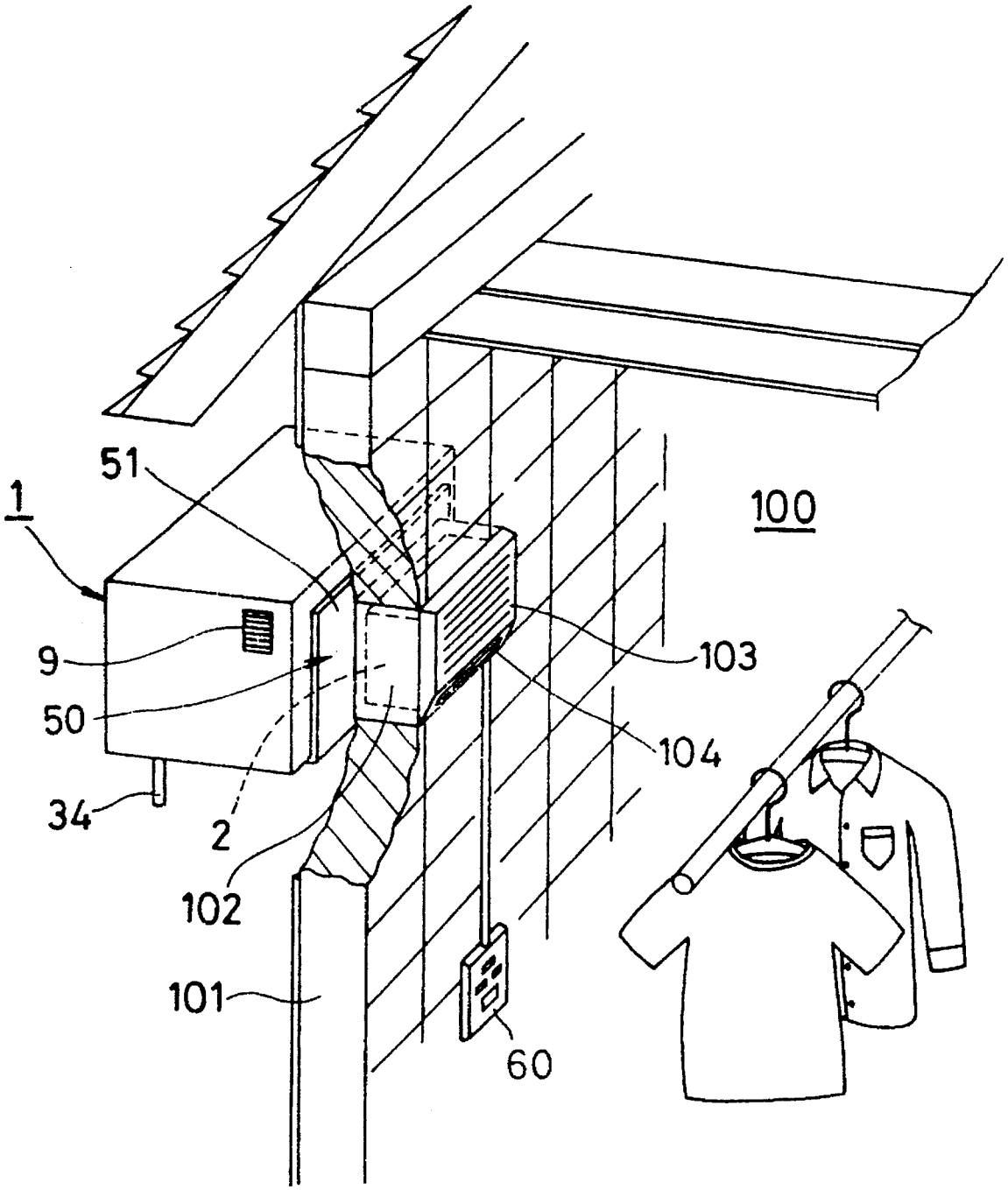
FIG. 2 is a schematic partial perspective view of a bathroom of a building provided with a ventilator/dryer assembly according to the invention.
Figure 3:
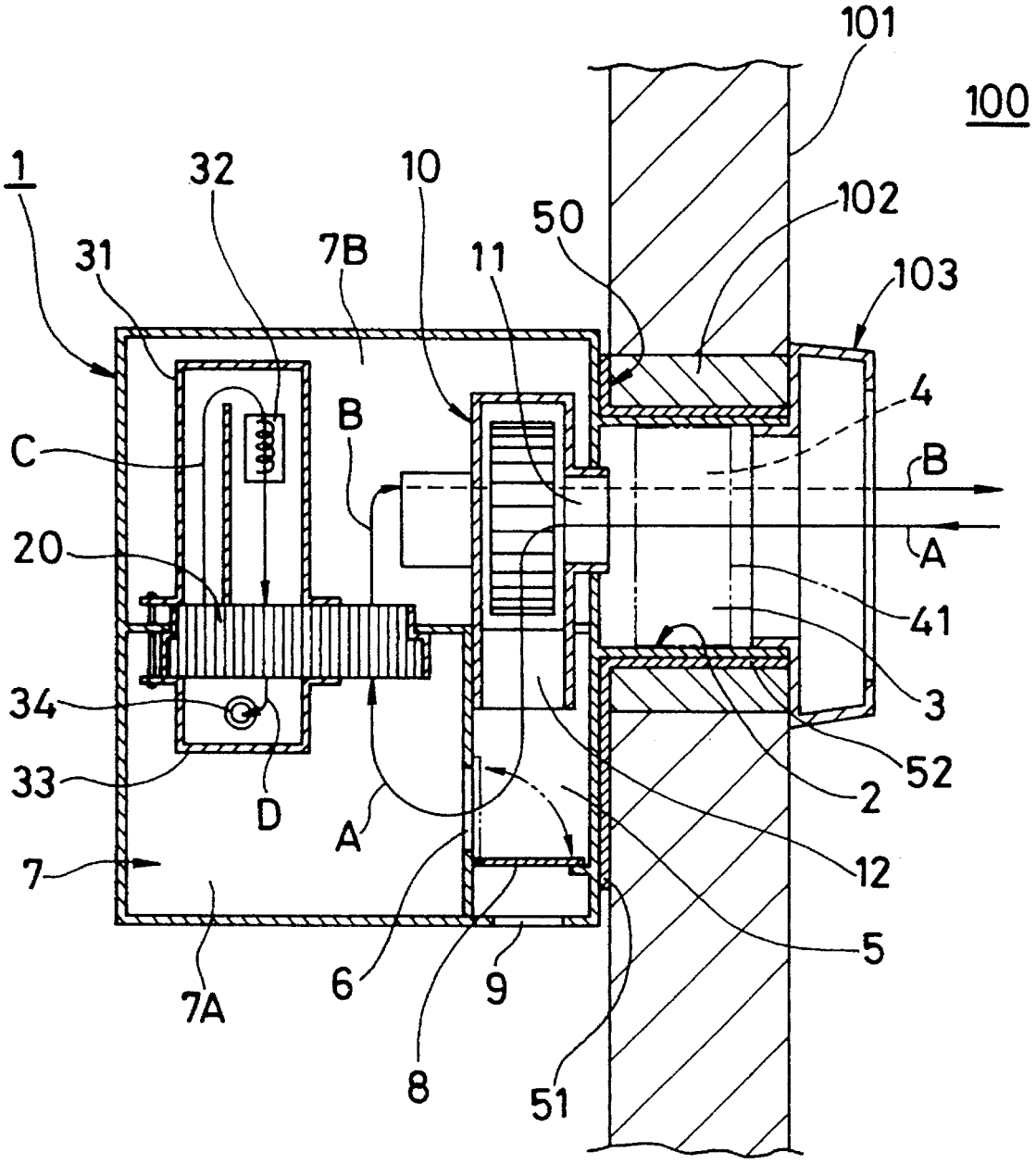
FIG. 3 is a schematic transversal cross sectional view of a ventilator/dryer assembly according to the invention fitted to the frame of a vent.
Figure 4:
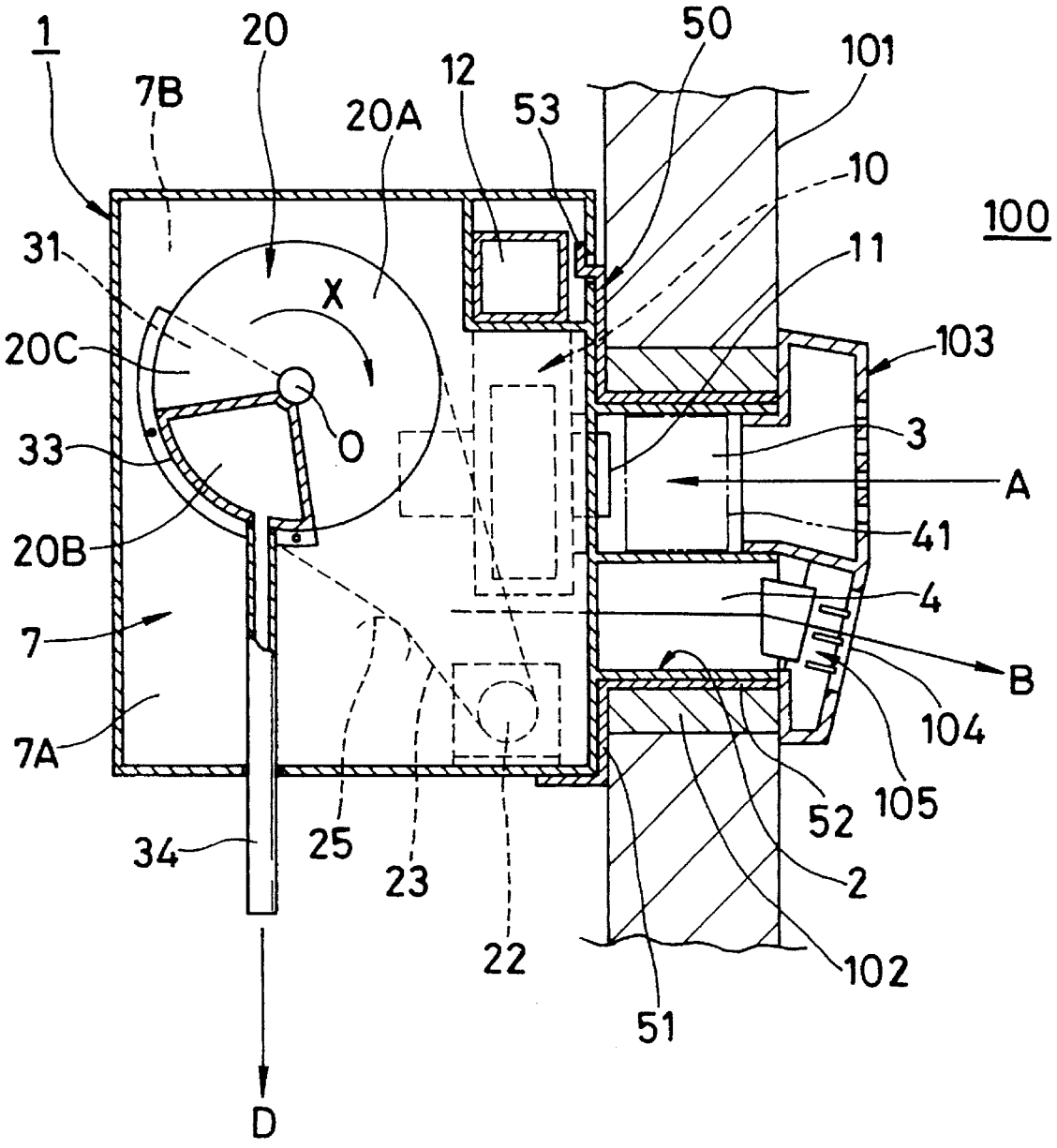
FIG. 4 is a schematic longitudinal cross sectional view of a ventilator/dryer assembly according to the invention fitted to the frame of a vent.

More specifically, as shown in FIGS. 2 to 4, the joint section 2 of the case main body 1 is so dimensioned that it can be tightly fitted from the outside into the frame 102 of an existing vent arranged on a wall 101 of a bathroom 100 of a building that serves as a laundry where washed wet cloths are hung for drying with the joint section 2 directed to the inside of the room. The case main body 1 is anchored to an adaptor plate 50 rigidly secured to the outer surface of the wall of the bathroom 100. Thus, the air inlet port 3 and the air outlet port 4 of the case main body 1 are located side by side on the wall 101 and exposed to the inside of the bath-room 100.

The adaptor plate 50 comprises a base plate section 51 having a surface area smaller than that of the front panel 1*a* of the case main body 1 and rectangularly projecting section 52 to be tightly fitted into the frame 102 of the vent. Thus the adaptor plate 50 is rigidly anchored to a beam or some other secure member of the building by appropriate fastening means such as screws after inserting the projecting section 52 into the frame 102 of the vent.

The adaptor plate 50 is also provided with a plurality of hooks 53 for hanging the case main body 1 at the front panel 1*a* thereof. The case main body 1 that is hanging from the hooks 53 is then rigidly secured to the adaptor plate 50 by appropriate fastening means such as screws.

Reference numeral 103 in FIGS. 2 to 4 denotes a grille removably fitted to the frame 102 of the vent from the inside of the bathroom and having a lower air outlet port 104, where a wind shifting mechanism 105 comprising a plurality of vertically rotatable guide vanes and horizontally rotatable guide vanes is provided.

Figure 7:
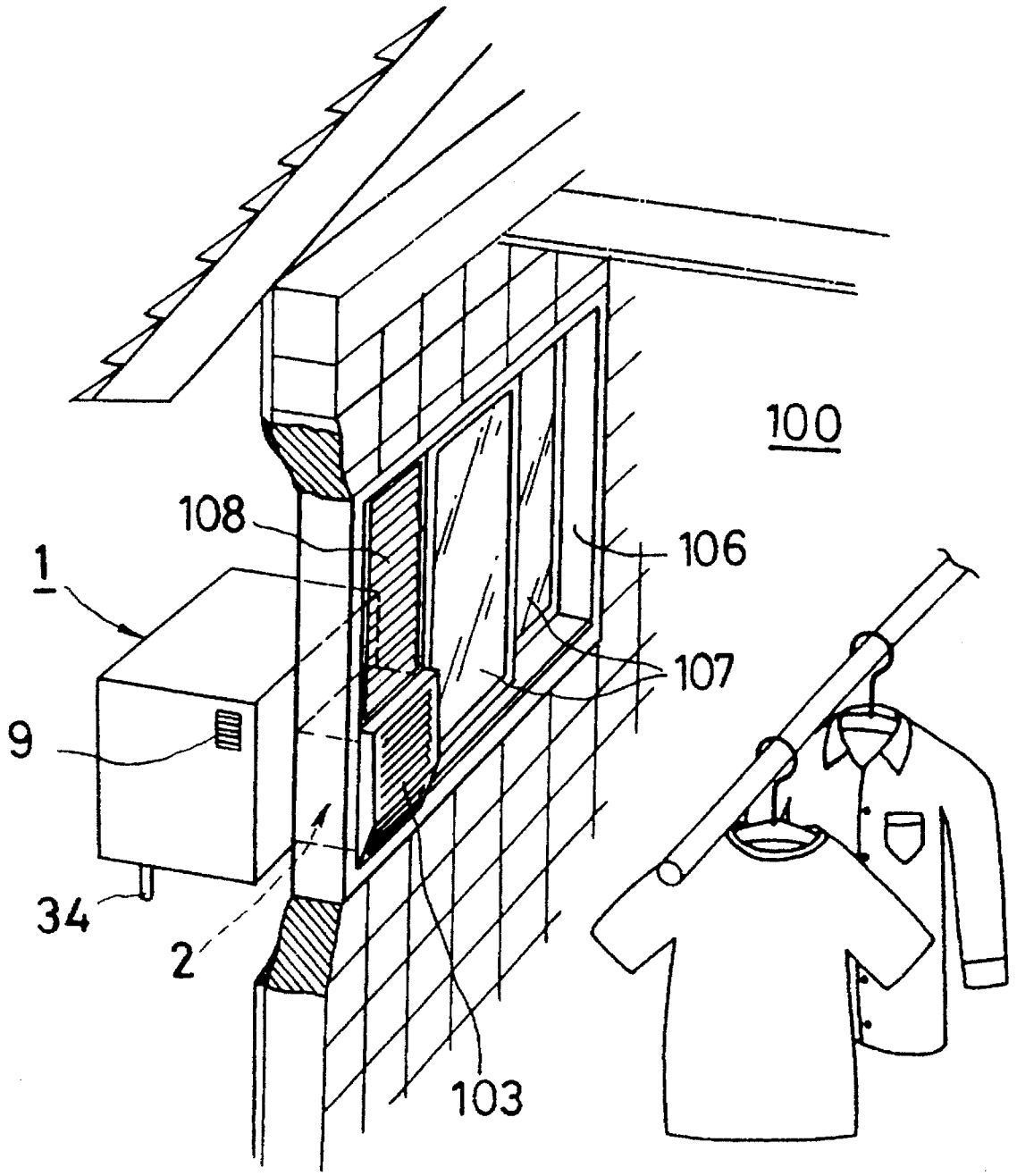
FIG. 7 is a schematic partial perspective view of a bathroom of a building provided at a sliding window thereof with a ventilator/dryer assembly according to the invention.
Figure 8:
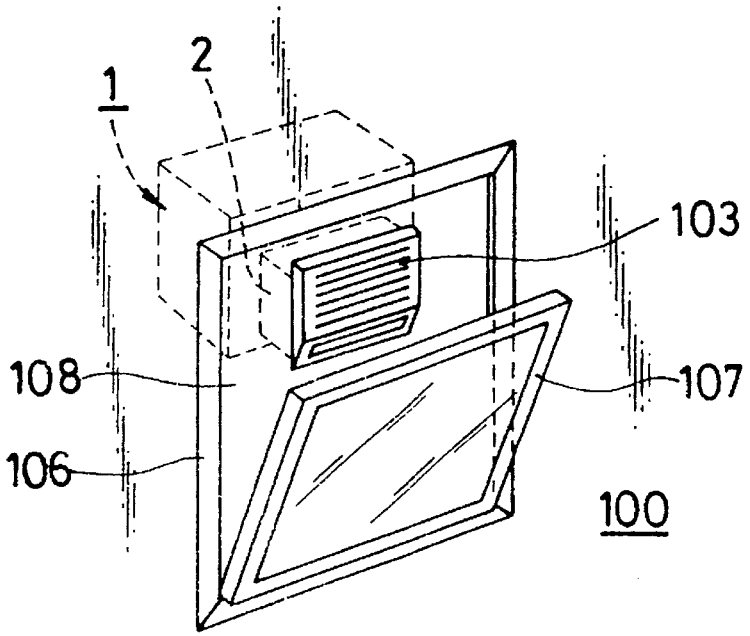
FIG. 8 is a schematic perspective view of a ventilator/dryer assembly according to the invention fitted to an inward-opening vertical swing window.
Figure 9:
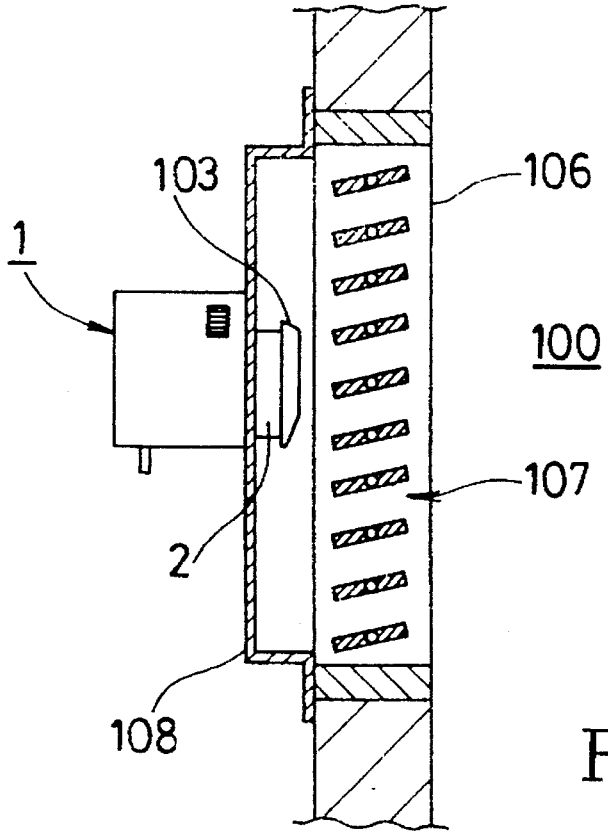
FIG. 9 is a schematic lateral view of a ventilator/dryer assembly according to the invention fitted to a jalousie window.

FIG. 7 shows an alternative arrangement for fitting the embodiment to the frame of not a vent but a sliding door of a bathroom 100. In this case, the sliding window 107 is half opened and the case main body 1 is rigidly secured to a support frame 108 from the outside of the bathroom 100. The support frame 108, which may be a panel or the like, is by turn secured to the frame 106 of the sliding window 107 in such a way that the joint section 2 is directed to the inside of the room. Still alternatively, the embodiment may be fitted to the frame 106 of an inward-opening vertical swing window as shown in FIG. 8 or to a jalousie window 107 as illustrated in FIG. 9.

With any of the above described arrangements, the embodiment of ventilator/dryer assembly according to the invention can be fitted to the outside of a room simply by securing the joint section of the front panel to the frame or a support member of the frame of a vent of the room without requiring a cumbersome operation of installing a ventilation duct or a drain system.

Figure 30:
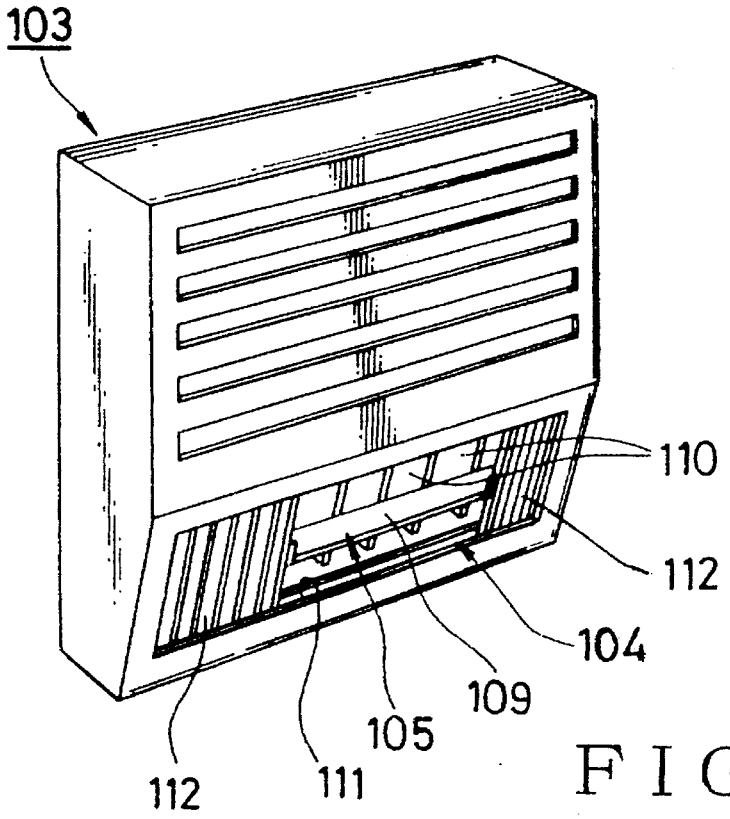
FIG. 30 is a schematic perspective view of the grille of a ventilator/dryer assembly according to the invention, fitted to the vent of the assembly.
Figure 31:
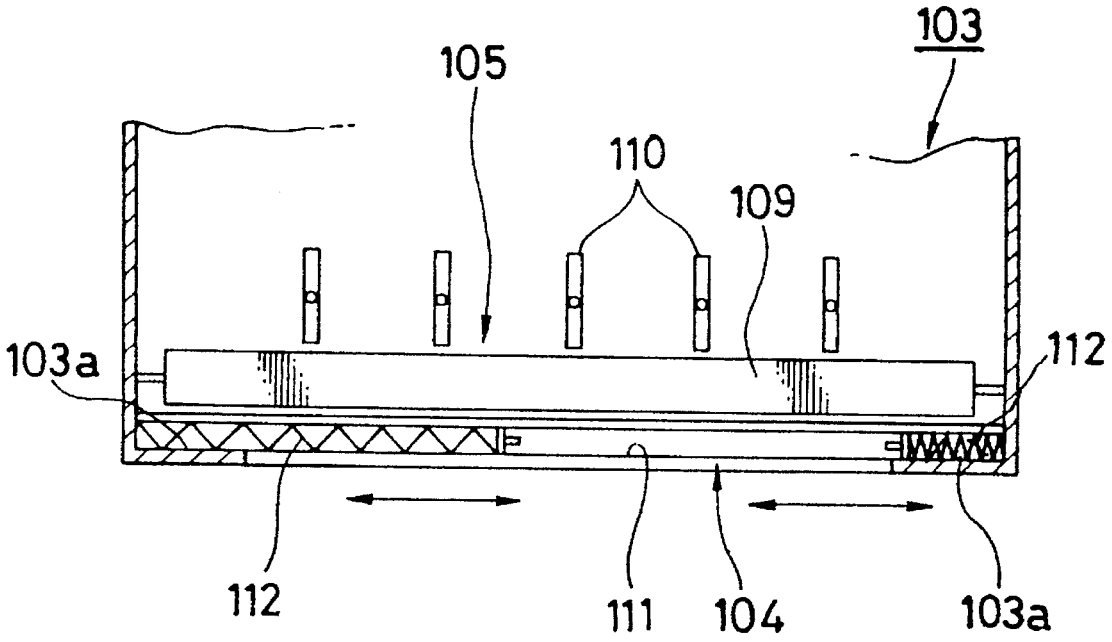
FIG. 31 is a schematic transversal cross sectional view of part of the grille of a ventilator/dryer assembly according to the invention.

On the other hand, the grille 103 is preferably provided at the lower opening 104 thereof with a wind shifting mechanism 105 as shown in FIGS. 30 and 31 in greater detail. Such a wind shifting mechanism 105 preferably comprises in combination a first set of vertically rotatable guide vanes 109 and a second set of horizontally rotatable guide vanes 110.

Still preferably, the grille 103 is additionally provided at the lower opening 104 thereof with a horizontal guide rail 111 and a pair of bellows-type shutters 112, 112 arranged on the guide rail 111 and capable of expanding and contracting laterally. With these shutters 112, 112, it is possible to select a desired open area for allowing air to pass through the opening 104. The shutters 112, 112 are housed in respective left and right shaded storage areas 103*a*, 103*a* in FIG. 31 when they are fully opened.

It would be understood that, with a grille having a configuration as described above, the flow of dry air blown out of the air outlet port of the embodiment can be controlled in terms of both rate and direction in order to maximize the effect of drying the inside of the room.

The inside of the case main body 1 is divided into a lead-in path 5 communicating with the air inlet port 3 of the joint section 2 and a treatment chamber 7 communication with the lead-in path 5 via a communication opening 6 arranged downstream relative to the lead-in path 5. The communication opening 6 may be provided with a damper 8 that can be opened and closed by means of a step motor. If such is the case, the damper 8 is remotely controlled by way of a wired remote control unit 60 and, in the ventilation mode of operation, the communication opening 6 may be automatically or manually blocked by the damper 8 so that wet air drawn in from the bathroom 100 through the air inlet port 3 by means of a forced circulation mechanism, which will be described later, is directly discharged out of the case main body 1 through a vent 9 arranged on a lateral side of the case main body and at the downstream end of the lead-in path 5 without passing through the treatment chamber 7.

In the drying mode of operation, on the other hand, the vent 9 of the lead-in path 5 is blocked by the damper 8.

Said forced circulation mechanism typically comprises a single centrifugal type blower 10 such as a sirocco fan having an inlet 11 arranged vis-a-vis the air inlet port 3 of the case main body and an air outlet port 12 arranged vis-a-vis the lead-in path 5. With this arrangement, it draws wet air A out of the bathroom via the air inlet port 3 and forwards it to the treatment chamber 7.

Said treatment chamber 7 is by turn divided into a primary side section 7A communicating with said lead-in path 5 and a secondary side section 7B communicating with the air outlet port 4 with a rotary drying device 20 arranged therebetween to separate them. The rotary drying device 20 is a stand-type drive that is driven to rotate by rotary drive means, which will be described later, with its rotary shaft O arranged horizontally and rectangularly relative to the direction of the stream of wet air A drawn into the blower 10 so that the device rotates clockwise in a vertical plane perpendicular to its rotary shaft O.

Figure 10:
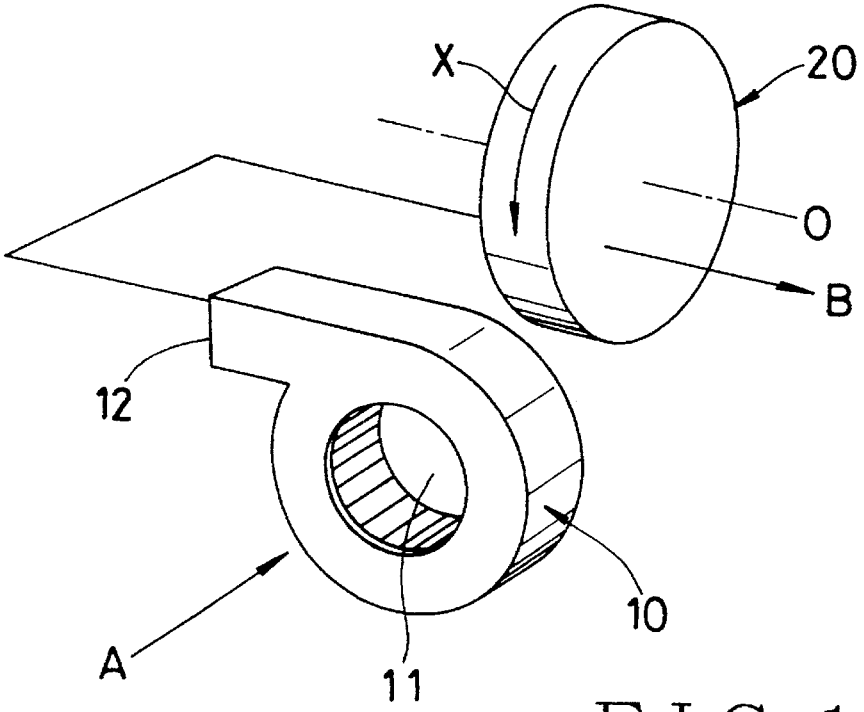
FIG. 10 is a schematic perspective view of the rotary drying device and the blower of a ventilator/dryer assembly according to the invention, showing a possible functional and positional relationship between them.
Figure 11:
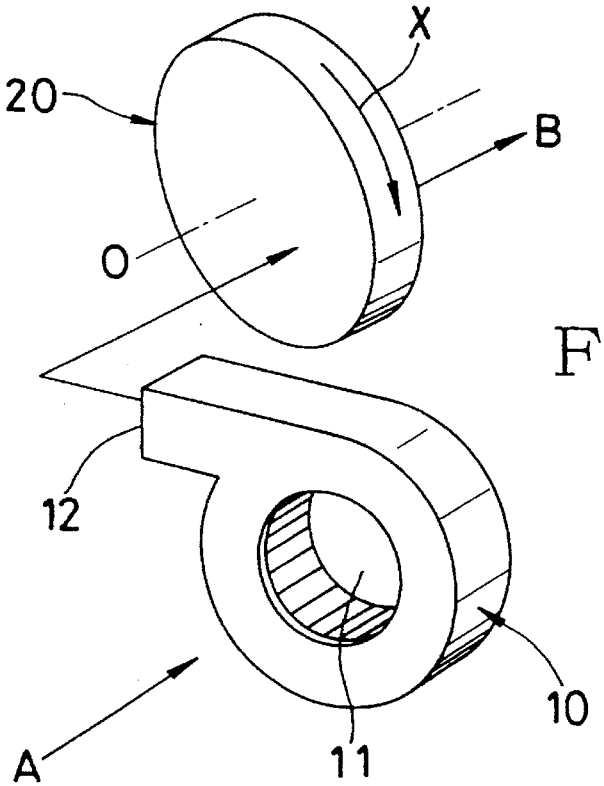
FIG. 11 is a schematic perspective view of the rotary drying device and the blower of a ventilator/dryer assembly according to the invention, showing another possible functional and positional relationship between them.
Figure 12:
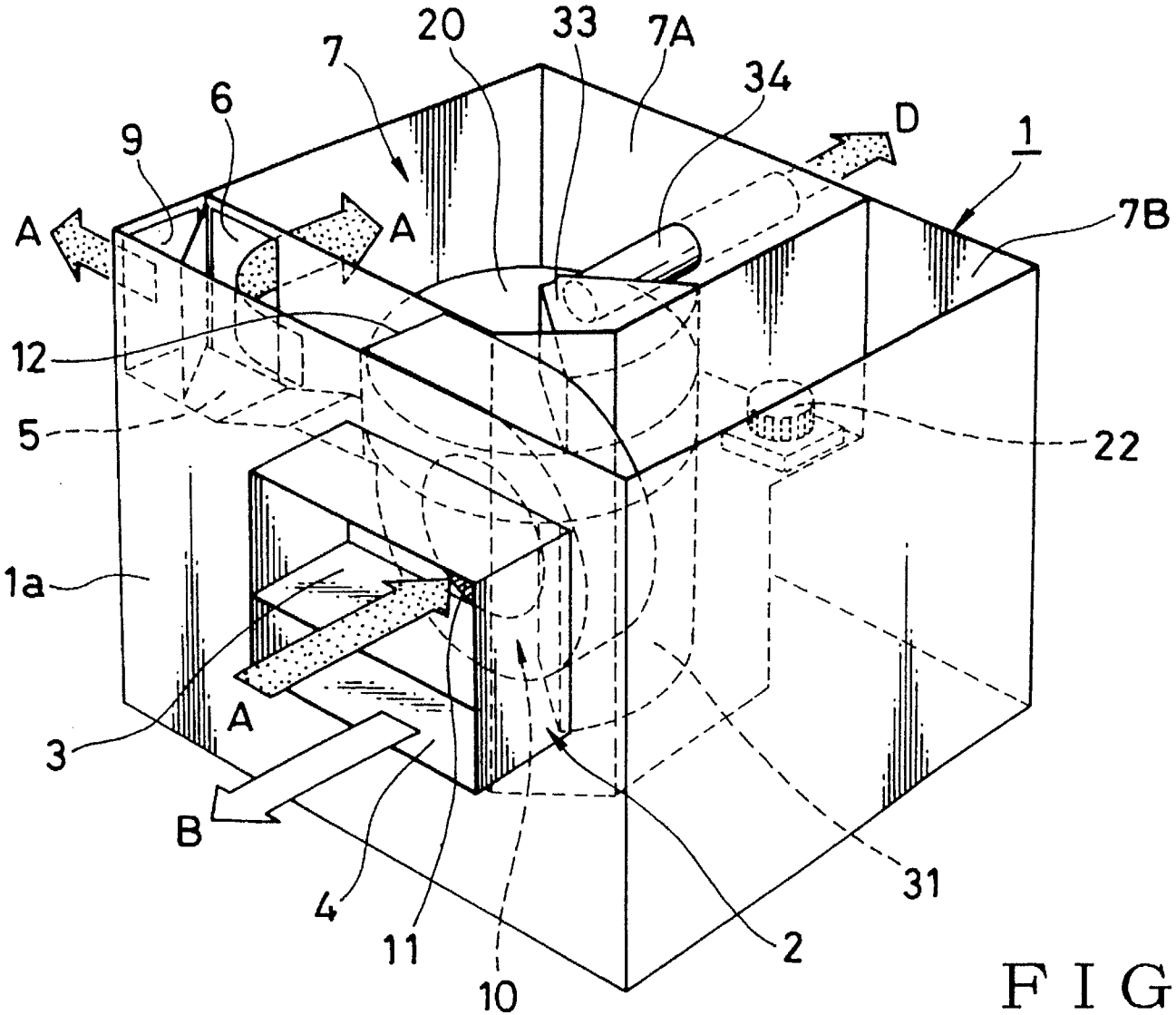
FIG. 12 is a schematic perspective view of another embodiment of ventilator/dryer assembly according to the invention.
Figure 13:
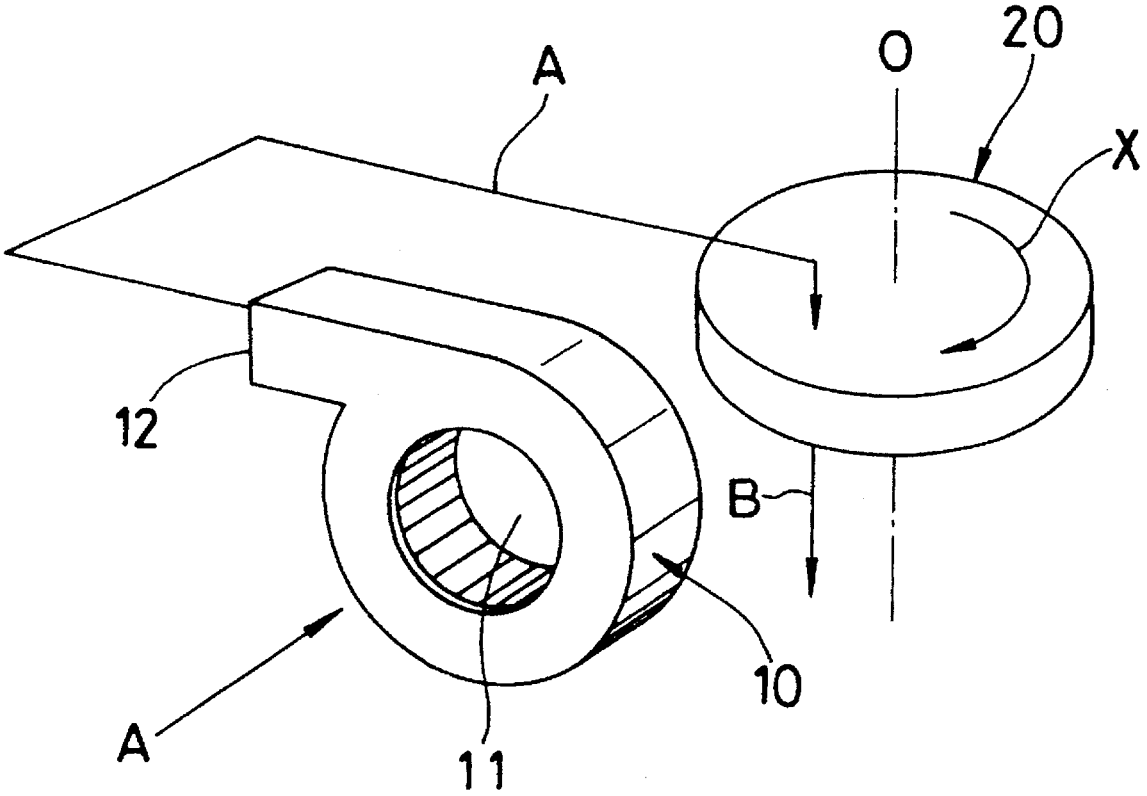
FIG. 13 is a schematic perspective view of the rotary drying device and the blower of a ventilator/dryer assembly according to the invention, showing still another possible functional and positional relationship between them.
Figure 14:
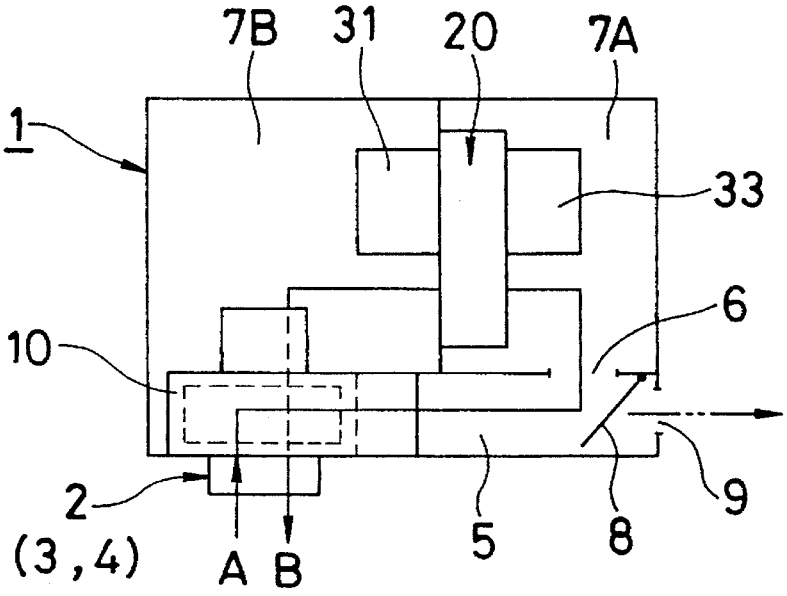
FIG. 14 is a schematic diagrammatic view of the rotary drying device and the blower of a ventilator/dryer assembly according to the invention, showing still another possible functional and positional relationship between them.
Figure 15:
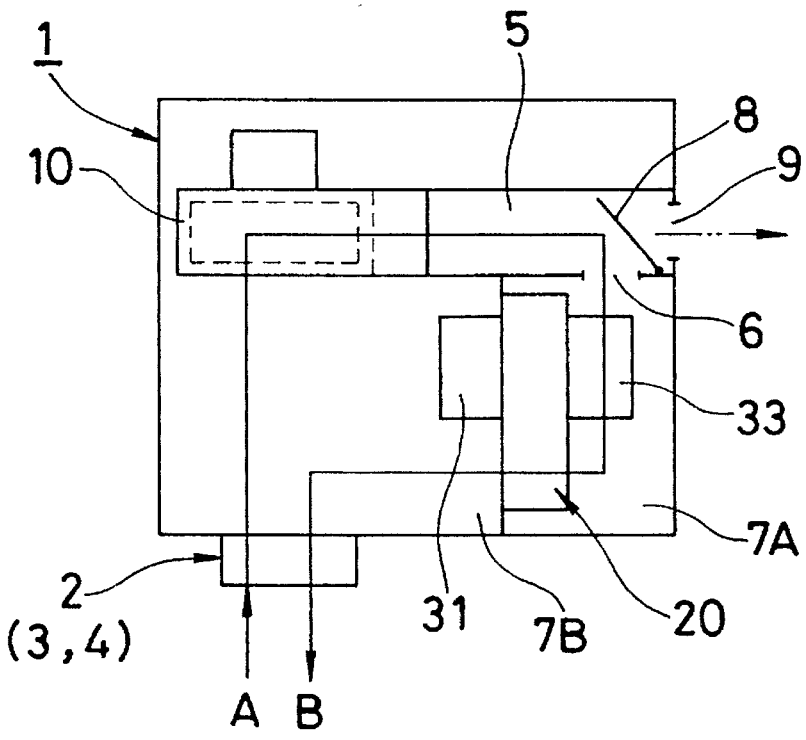
FIG. 15 is a schematic diagrammatic view of the rotary drying device and the blower of a ventilator/dryer assembly according to the invention, showing still another possible functional and positional relationship between them.
Figure 16:
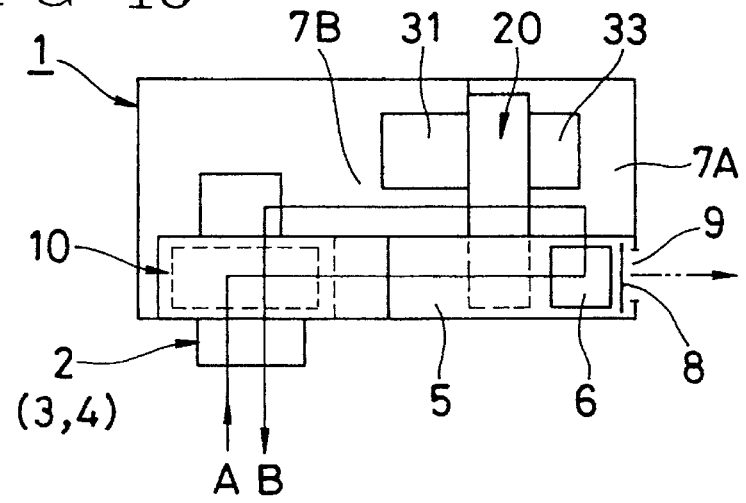
FIG. 16 is a schematic diagrammatic view of the rotary drying device and the blower of a ventilator/dryer assembly according to the invention, showing still another possible functional and positional relationship between them.
Figure 17:
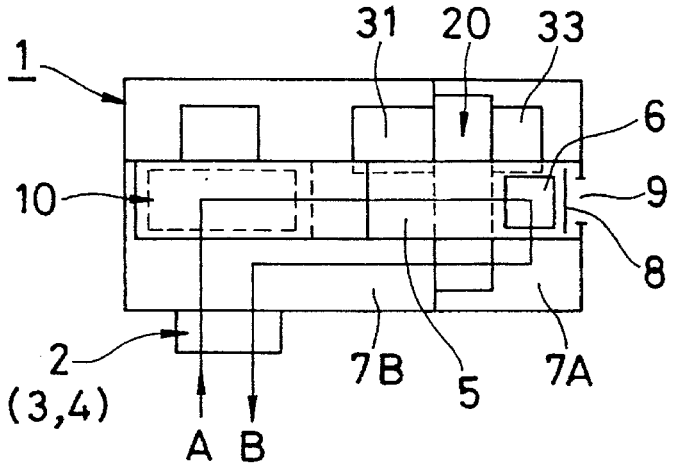
FIG. 17 is a schematic diagrammatic view of the rotary drying device and the blower of a ventilator/dryer assembly according to the invention, showing still another possible functional and positional relationship between them.
Figure 18:
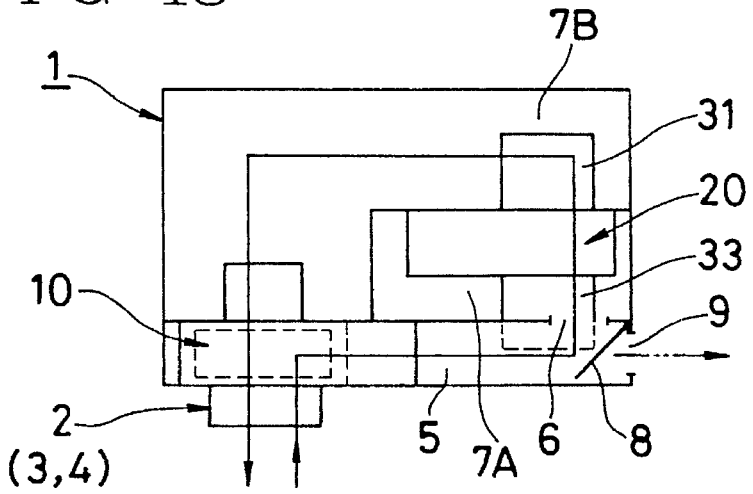
FIG. 18 is a schematic diagrammatic view of the rotary drying device and the blower of a ventilator/dryer assembly according to the invention, showing still another possible functional and positional relationship between them.
Figure 19:
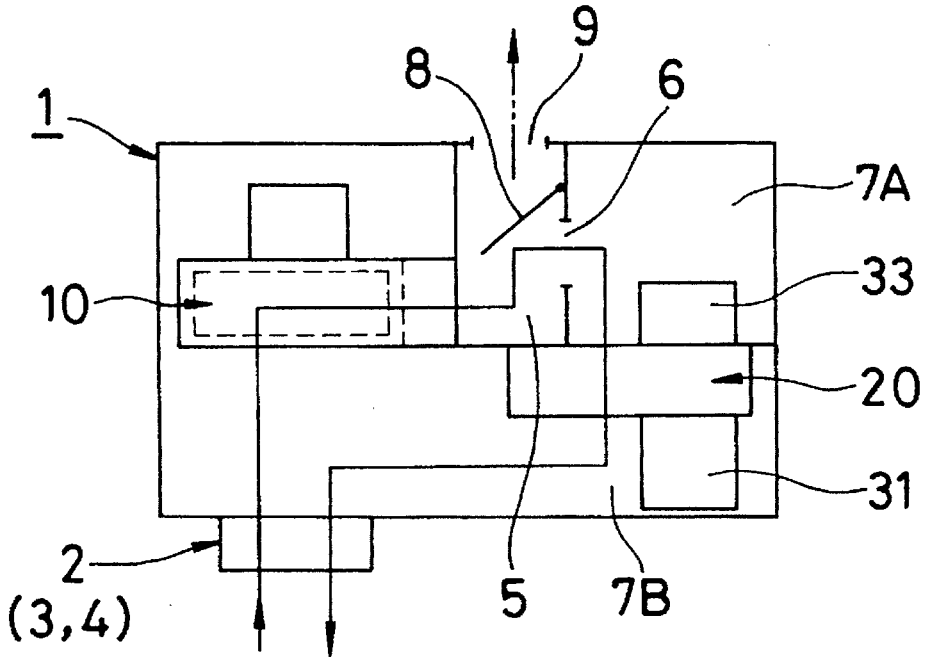
FIG. 19 is a schematic diagrammatic view of the rotary drying device and the blower of a ventilator/dryer assembly according to the invention, showing still another possible functional and positional relationship between them.
Figure 20:
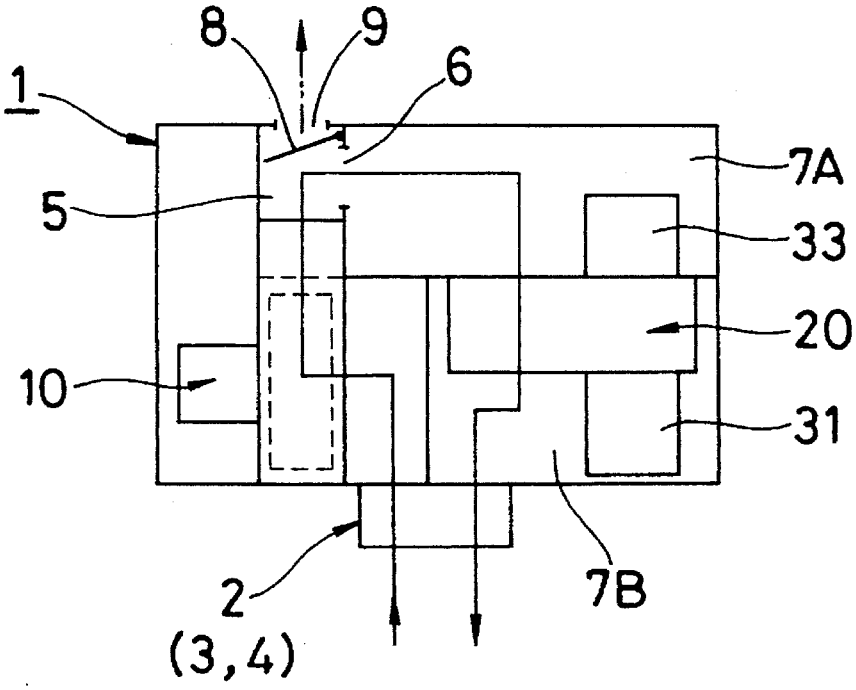
FIG. 20 is a schematic diagrammatic view of the rotary drying device and the blower of a ventilator/dryer assembly according to the invention, showing still another possible functional and positional relationship between them.
Figure 21:
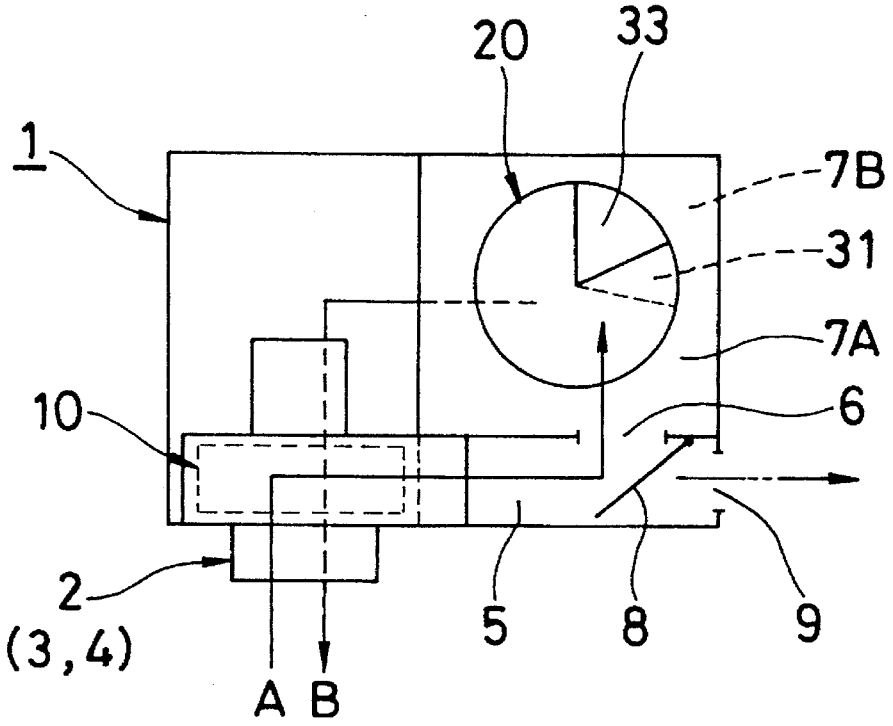
FIG. 21 is a schematic diagrammatic view of the rotary drying device and the blower of a ventilator/dryer assembly according to the invention, showing still another possible functional and positional relationship between them.
Figure 22:
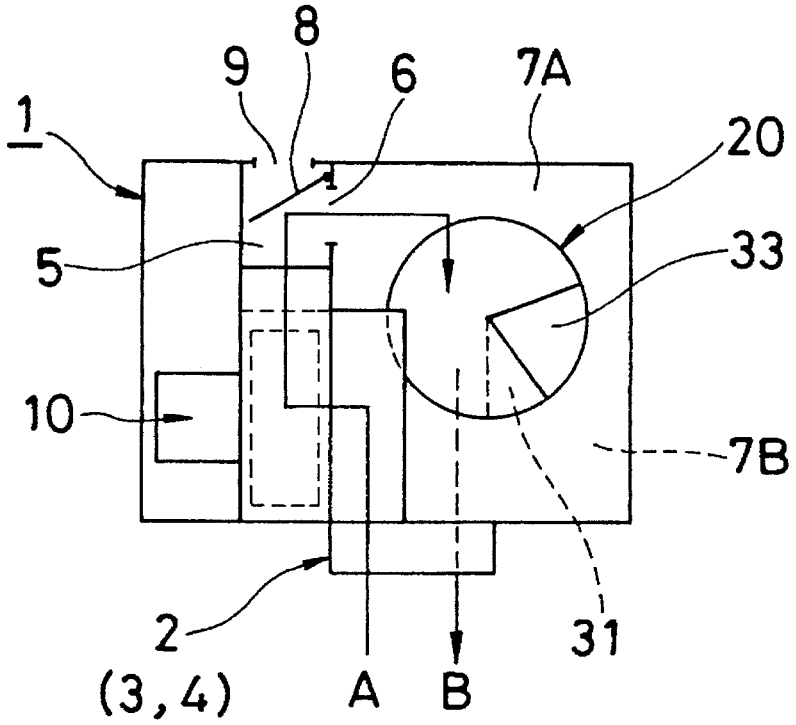
FIG. 22 is a schematic diagrammatic view of the rotary drying device and the blower of a ventilator/dryer assembly according to the invention, showing still another possible functional and positional relationship between them.

While the rotary shaft O of the rotary drying device 20 of the above embodiment is horizontal and rectangular relative to the direction of the stream of wet air A drawn into the blower 10 so that the device rotates clockwise in a vertical plane perpendicular to its rotary shaft O as illustrated in FIG. 10 and described above, it may alternatively be arranged horizontally and in parallel with the direction of the stream of wet air A taken into the blower 10 as illustrated in FIG. 11. Still alternatively, it may be arranged vertically and rectangularly relative to the direction of the stream of wet air A taken into the blower 10 so that the device rotates clockwise in a horizontal plane perpendicular to its rotary shaft Q as illustrated in FIGS. 2 and 13.

FIGS. 14 through 22 show possible alternative positional arrangements the rotary drying device and the blower of a ventilator/dryer assembly according to the invention and corresponding routes of circulation of wet air.

Figure 23:
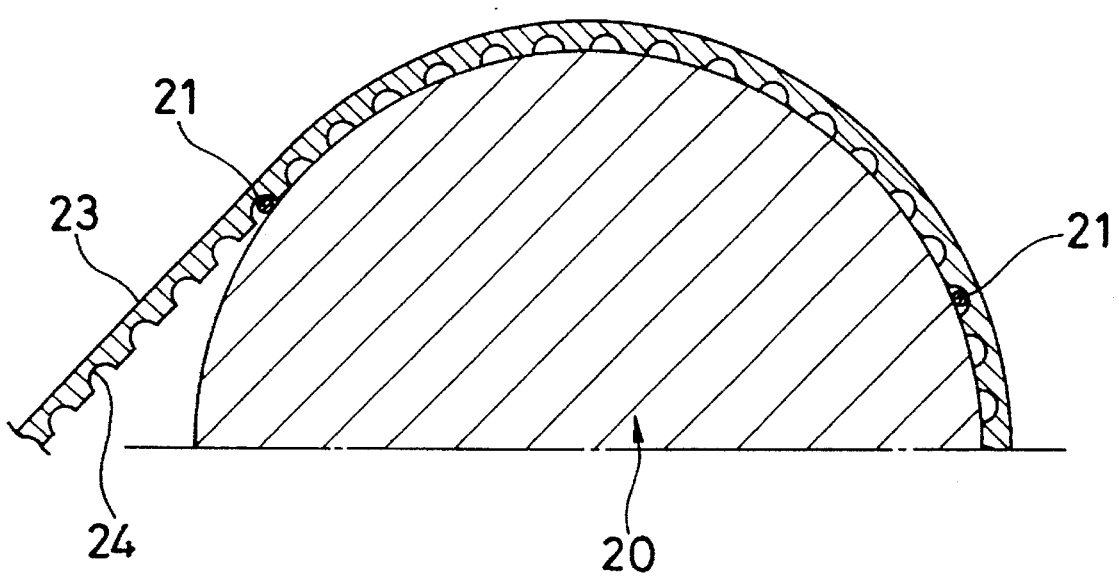
FIG. 23 is a partial transversal cross sectional view of the rotary drying device and the driving belt of a ventilator/dryer assembly according to the invention, showing their mutual engagement.
Figure 24:
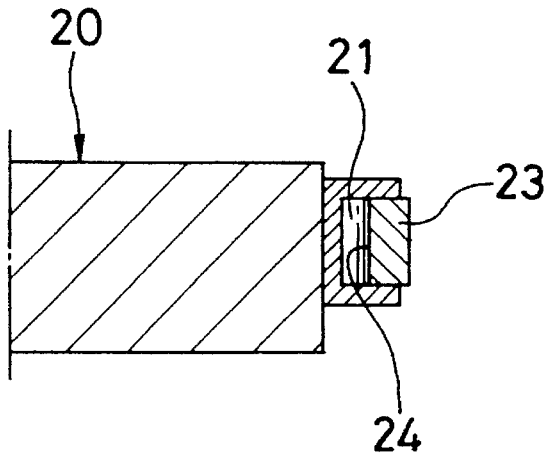
FIG. 24 is a partial longitudinal cross sectional view of the rotary drying device and the driving belt of a ventilator/dryer assembly according to the invention, showing their mutual engagement.

As shown in FIGS. 5, 23 and 24, on the other hand, the drive means for rotating the rotary drying device 20 comprises in combination a number of teeth 21 arranged with regular intervals on the outer peripheral surface and in a same radial plane of the rotary drying device 20, a drive motor 22 and an endless driving belt 23 fitted to the rotary shaft of the drive motor 22 and having a number of indentations 24 arranged on the inner surface thereof, at least one of the teeth 21 of the rotary drying device 20 being engaged with one of the indentations 24 of the driving belt 23 to drive the rotary drying device 20 to rotate at a predetermined rate of rotation. The drive means additionally comprises a tension spring 25 constantly urging the driving belt 23 to constantly keep the latter under pressure.

With the above described arrangement, the rotary drying device 20 can be driven to rotate for certainty without causing any slippage on the part of the driving belt if it does not carry teeth arranged over the entire outer peripheral surface thereof with a pitch same as that of the indentations 24 of the driving belt 23 for mutual engagement.

The rotary drying device 20 is adapted to take a drying position 20A, a regenerating position 20B and a heat recovering position 20C arranged sequentially in the sense of rotation X. A regenerating shell 31 is arranged in the secondary side section 7B of the treatment chamber 7 vis-a-vis the heat recovering position 20C of the rotary drying device 20 in order to branch the flow of wet air A fed into the primary side section 7A of the treatment chamber 7 and turn the branched air flow round toward the regenerating position 20B so that a flow of regenerating air C is produced, running opposite to the flow of wet air A. An electric heater (PTC heater) 32 is arranged in the regenerating chamber 31.

On the other hand, an air discharging shell 33 is arranged in the primary side section 7A the treatment chamber 7 vis-a-vis the regenerating position 20B of the rotary drying device 20 at a position exactly opposite to the regenerating shell 31 and connected with an exhaust pipe 34 for discharging exhaust air D that has been used for heating and regenerating the rotary drying device 20 in the regenerating position 20B is discharged out of the case main body 1 via the bottom or a lateral side thereof. The exhaust pipe 34 is provided in the inside with a filtering member (not shown) such as a metal meshwork for blocking rain drops entering the pipe and preventing it from being damaged by wind.

Note that the amount of wet air A discharged from the apparatus in the ventilation mode or the amount of exhaust air D discharged in the drying mode of operation is offset by the same amount of fresh air entering the bathroom 100 through a door gallery or a louver thereof.

Figure 25:
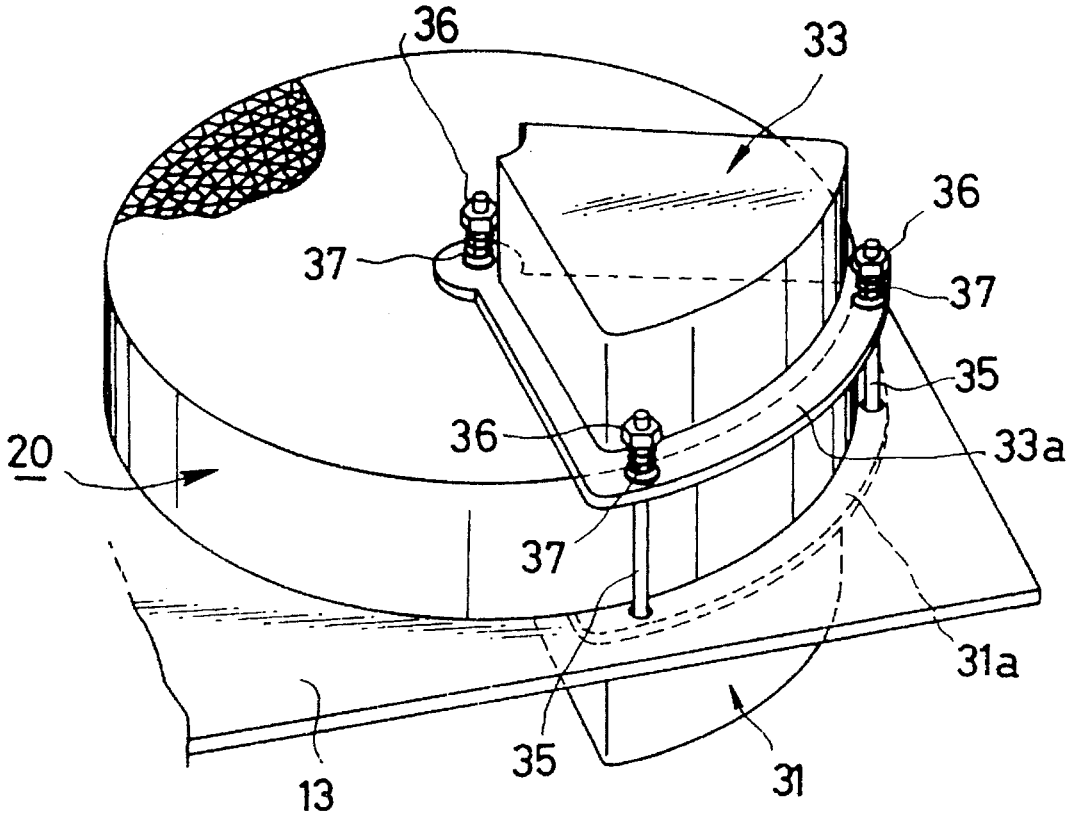
FIG. 25 is a schematic perspective view of the rotary drying device and the regenerating and discharging shells of a ventilator/dryer assembly according to the invention, showing how the shells are secured to the rotary drying device.
Figure 26:
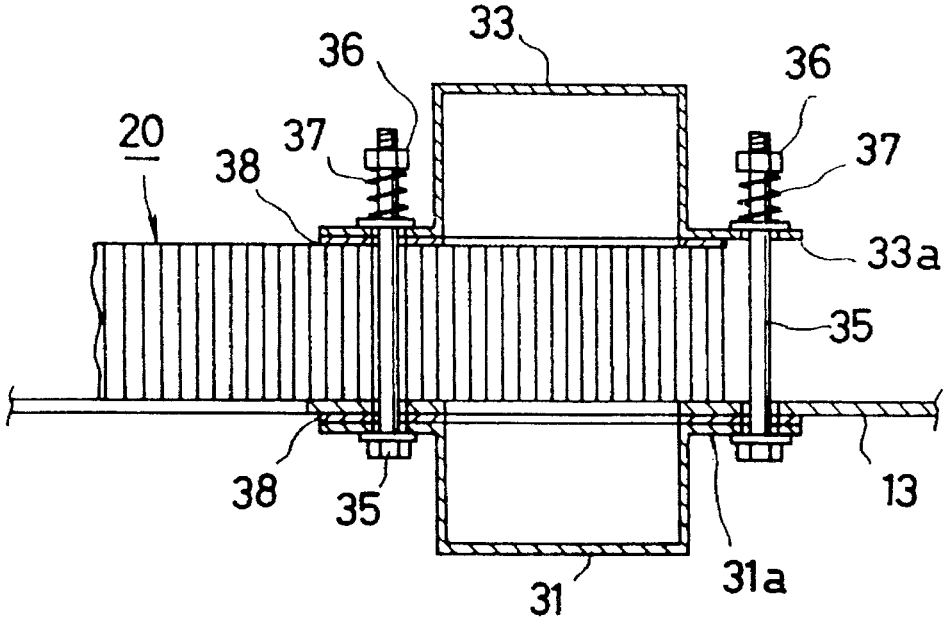
FIG. 26 is a schematic longitudinal cross sectional view of part of the rotary drying device and the regenerating and discharging shells of a ventilator/dryer assembly according to the invention, showing how the shells are secured to the rotary drying device.

The air discharging shell 33 is disposed exactly opposite to the regenerating shell 31 with the rotary drying device 20 and the partition 13 arranged therebetween as shown in FIGS. 25 and 26. The air discharging shell 33 and the regenerating shell 31 are coupled together by means of three long bolts 35 passing through the flange 33*a* of the air discharging shell 33 and the corresponding flange 31*a* of the regenerating shell 31 such that they are resiliently pulled toward each other due to springs 37 arranged around the respective bolts 35 and confined by nuts 36 held in engagement with the respective bolts 35. Consequently, the rotary drying device 20 is resiliently pressed against the partition 13 and the flange 33*a* of the air discharging shell 33 and the flange 31*a* of the regenerating shell 31 are held in close contact with the respective operative surfaces of the rotary drying device 20 by the biasing force of the springs 37.

Figure 29:
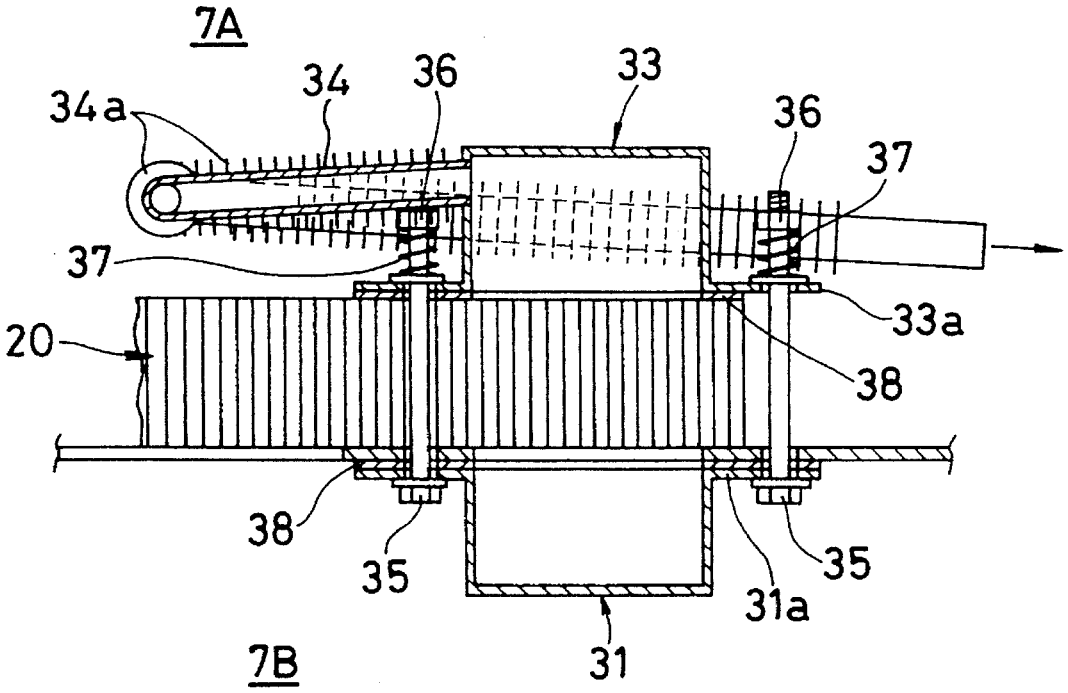
FIG. 29 is a schematic longitudinal cross sectional view of part of the rotary drying device and the regenerating and discharging shells of a ventilator/dryer assembly according to the invention, showing how the shells are secured to the rotary drying device.

In FIGS. 26 and 29, reference numeral 38 denotes sealing members respectively arranged between the flange 33*a* of the air discharging shell 33 and the corresponding operative surface of the rotary drying device 20 and between the flange 31*a* of the regenerating shell 31 and the corresponding operative surface of the rotary drying device 20.

Figure 27:
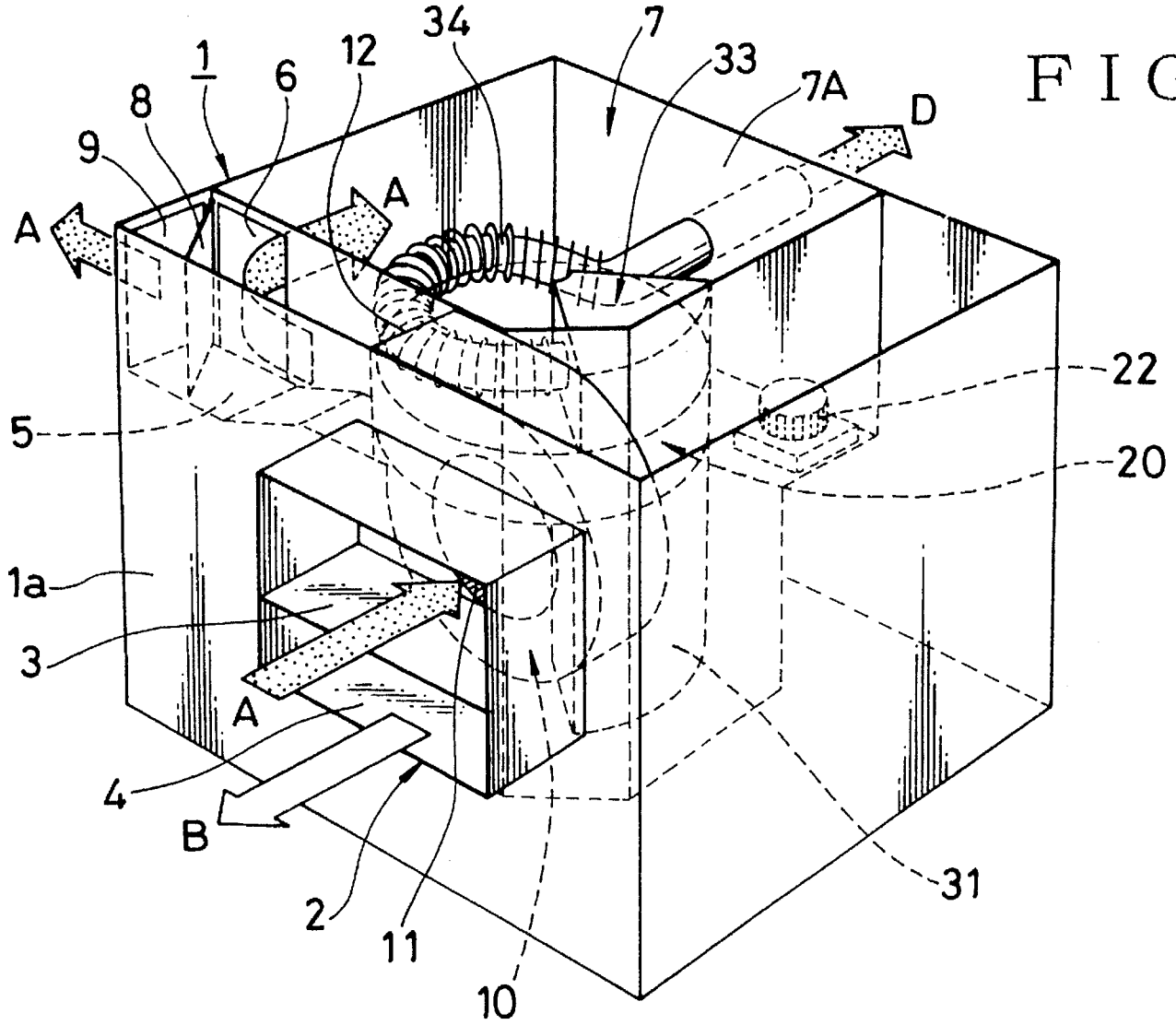
FIG. 27 is a schematic perspective view of another embodiment of ventilator/dryer assembly according to the invention.
Figure 28:
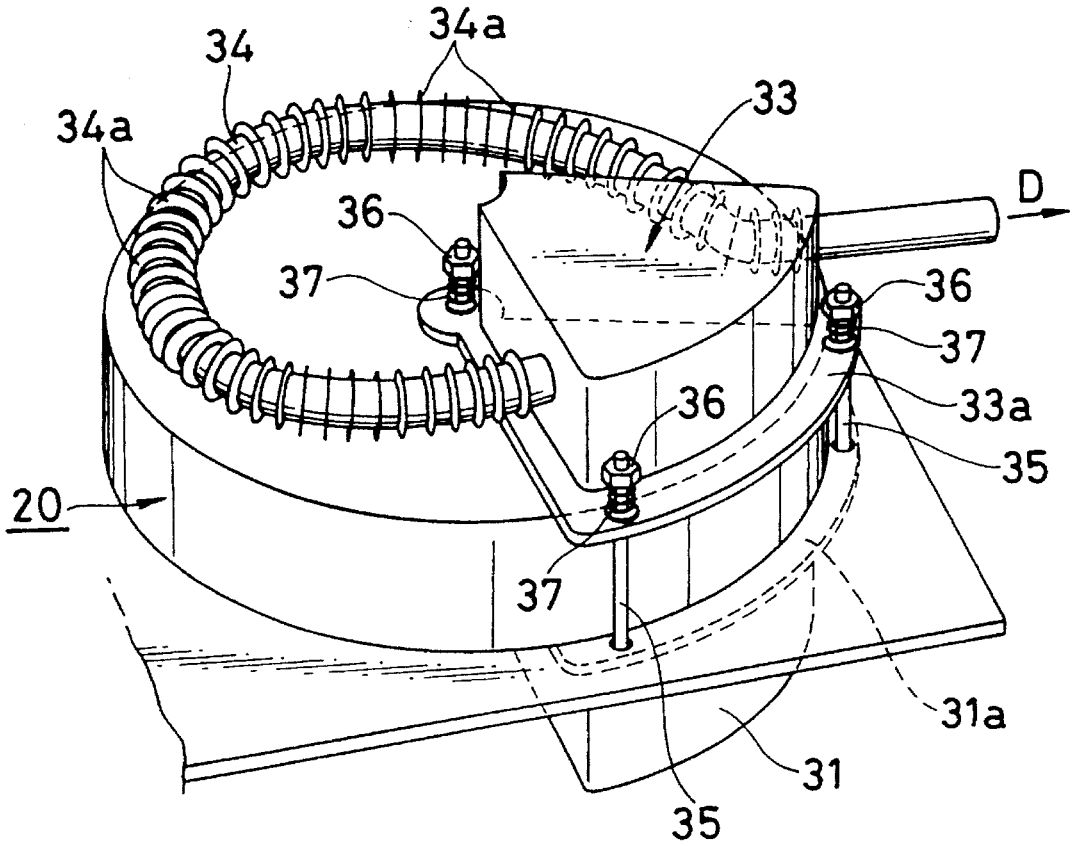
FIG. 28 is a schematic perspective view of the rotary drying device and the regenerating and discharging shells of a ventilator/dryer assembly according to the invention, showing how the shells are secured to the rotary drying device.

As shown in FIGS. 27, 28 and 29, the exhaust pipe 34 connected to the air discharging shell 33 is preferably arranged in the primary side section 7A of the treatment chamber 7 along the outer periphery of the rotary drying device 20 in the sense of rotation X thereof and inclined from the inlet side toward the outlet side. Additionally, it is preferably provided on the outer peripheral surface thereof with a number of fins 34*a*. With such an arrangement, the exhaust pipe 34 heated by hot air coming from the regenerating position of the rotary drying device 20 emits by return heat to raise the temperature of dried heat in the room and consequently improve the efficiency of drying the inside of the room so that an electric heater with a relatively low capacity may be used.

The air inlet port 3 in the joint section 2 of the case main body 1 is provided with an air filter 41.

With the embodiment of ventilator/dryer assembly as described above, wet air A drawn out of the bathroom 100 into the case main body through the air inlet port 3 by means of the blower 10 is made to enter the lead-in path 5 and then the primary side section 7A of the treatment chamber 7 via the communication opening 6 in the drying mode of operation. Wet air A in the primary side section 7A of the treatment chamber 7 is then forced to pass through the rotary drying device 20, where the moisture contained therein is adsorbed to the device to produce dry air B, which is driven into the secondary side section 7B of the treatment chamber 7 and then forced out into the bathroom 100 via the air outlet port 4 to complete a closed circle for air circulation in the bathroom 100.

More specifically, the drying position 20A of the rotary drying device 20 has a function of allowing wet air A drawn into the primary side section 7A of the treatment chamber 7 to pass through the rotary drying device 20 for drying it by adsorption of moisture and feeding dried air B into the secondary side section 7B of the treatment chamber 7. On the other hand, the regenerating position 20B of the rotary drying device 20 operates to allow hot air (regenerating air) C to pass through the rotary drying device 20 that has adsorbed moisture in the drying position 20A and remove the moisture on the rotary drying device 20 in order to regenerate the latter.

Finally, the heat recovering position 20C has a function of allowing air to pass through the rotary drying device 20 that has been heated in the regenerating position 20B to cool the device 20. The flow of wet air A introduced into the primary side section 7A of the treatment chamber 7 is branched in order to utilize the air partly as regenerating air C that is made to pass through the rotary drying device 20 that has been heated in the regenerating position 20B to recover heat from the device 20. Thereafter, regenerating air C is heated by the electric heater 32 and sent to the regenerating position 20B.

The rotary drying device 20 is a cylindrical device produced by polymerizing metal silicate gel prepared from silica gel and a plurality of different metals such as cobalt, iron and manganese in a ceramic honeycomb laminate, regulating the profile of the micropores of the prepared metal silicate gel to make it adapted to water molecules and depositing a large number of hydroxyl groups in the micropores to enhance the hydrophilic property of the device so that it can adsorb and release moisture effectively and efficiently. The device typically has a diameter of 20 cm and is rotated at a rate of a half revolution per minutes.

When the surface areas of the rotary drying device 20 adapted respectively to the drying position 20A, the regenerating position 20B and the heat recovering position 20C that are arranged sequentially in the sense of rotation of the device 20 are defined in terms of central angles θ1, θ2 and θ3, these angles preferably show a relationship of θ1>=θ2>=θ3. Typically, the relationship may be defined by θ1:θ2:θ3=5:2:1. The rate of air flow in the drying position 20A to the corresponding rate in the regenerating position 20B may be 200($m^3$/h):20($m^3$/h).

It may be understood that the diameter, the rate of rotation, the ratio of the central angles of the drying position 20A and the regenerating position 20B and the heat recovering position 20C or θ1:θ2:θ3 as well as the ratio of the rate of air flow ($m^3$/h) in the drying position 20A and the corresponding rate in the regenerating position 20B may be other than those cited above depending on the required drying capacity of the apparatus.

The capacity of the electric heater 32 for heating regenerating air C in the heat recovering position 20C may typically be 450 W to raise the temperature of dry air B blown out into the room through the air outlet port 4 by about 6 degrees from the room temperature.

In order to improve the effect of sterilizing the air and the washed cloths in the room, an ozone generator may be arranged within the case main body 1 so that ozone can be blown into the room with dry air B.

While the embodiment is fitted in a bathroom of a detached house in the above description, it may alternatively be installed in an apartment house having a unitized bathroom. If such is the case, the joint section 2 of the case main body 1 of the ventilator/dryer assembly is fitted into the vent of the bathroom facing a corridor or a veranda while a pair of ducts respectively connected to the air inlet port 3 and the air outlet port 4 may be made to communicate with a vent arranged in the ceiling.

Now, the control system of the forced circulation mechanism of the embodiment will be described by referring to FIGS. 32 through 37.

Figure 32:
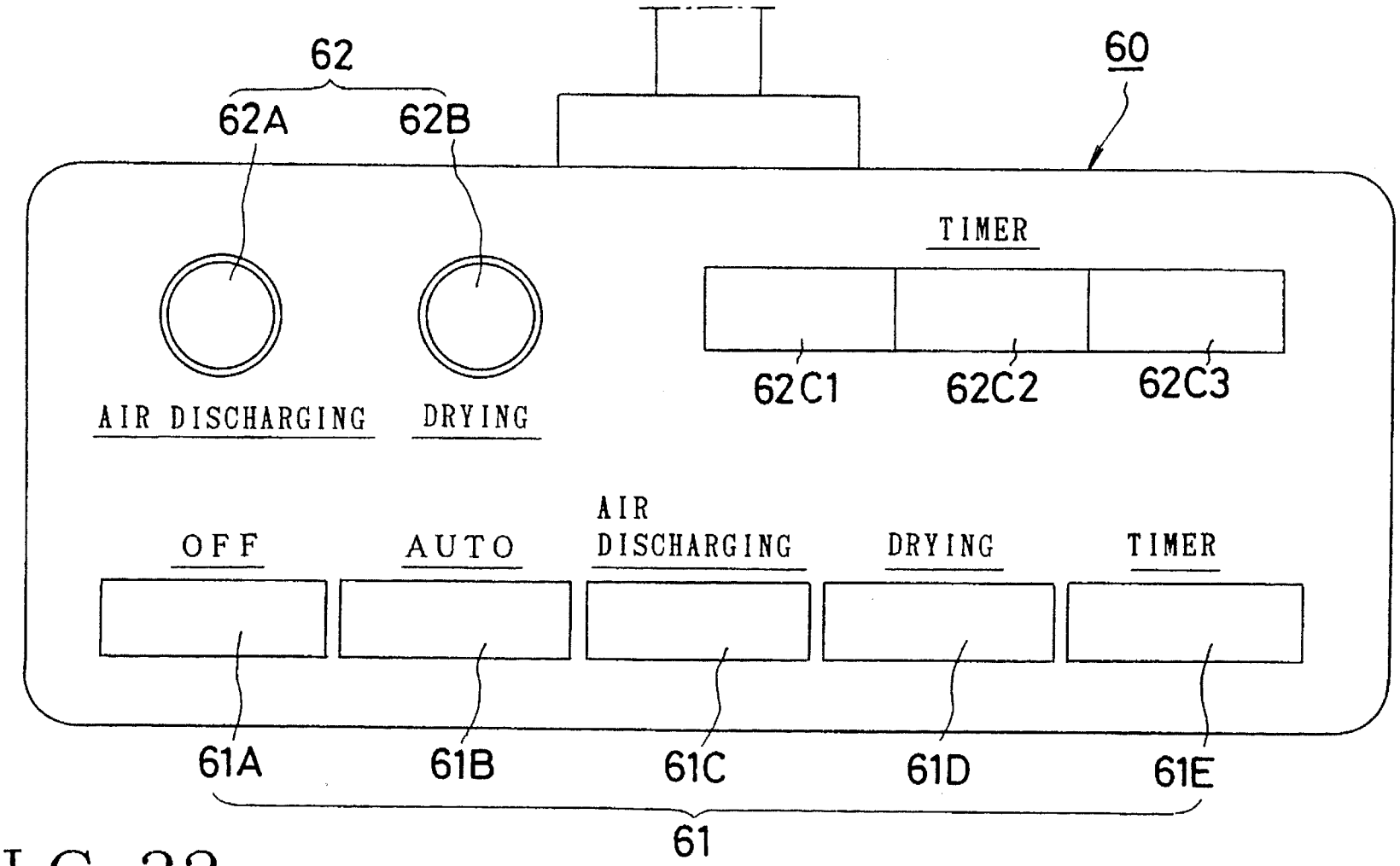
FIG. 32 is a schematic plan view of the control panel of the wired remote control unit of a ventilator/dryer assembly according to the invention.

FIG. 32 is a schematic plan view of the control panel of the wired remote control unit of the embodiment. The control panel carries thereon switches 61 including an OFF switch 61A, an automatic (AUTO) operation switch 61B, an air discharging switch 61C, a drying switch 61D and a timer selection switch 61E (e.g, 1H, 2H, 3H) and indicators 62 such as an air discharging mode indicator 62A, a drying mode indicator 62B and timer indicators 62C1 through 62C3. Each of the indicators contains a light emitting diode that flashes whenever energized.

Figure 33:
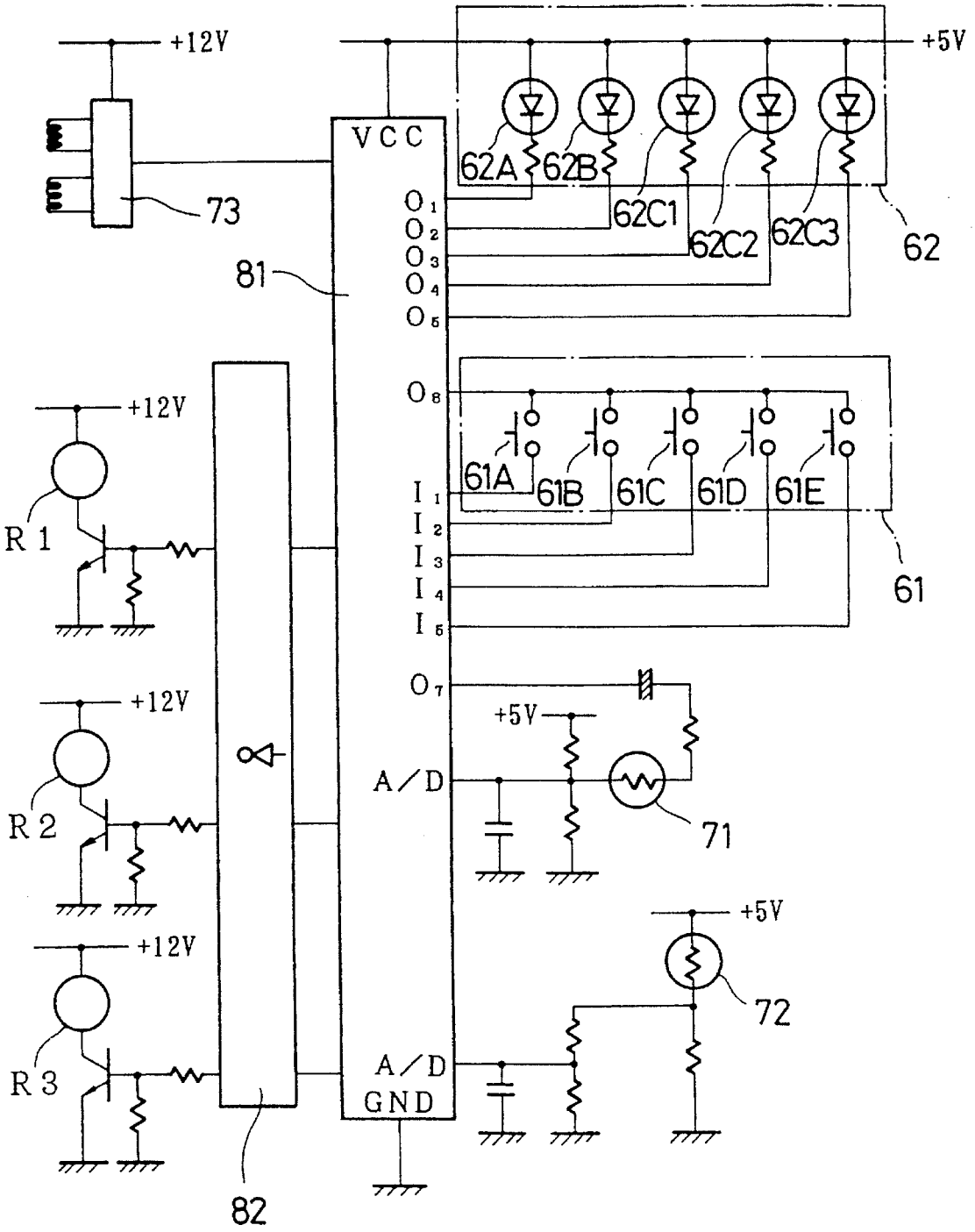
FIG. 33 is a circuit diagram of the control circuit of a ventilator/dryer assembly according to the invention.
Figure 34:
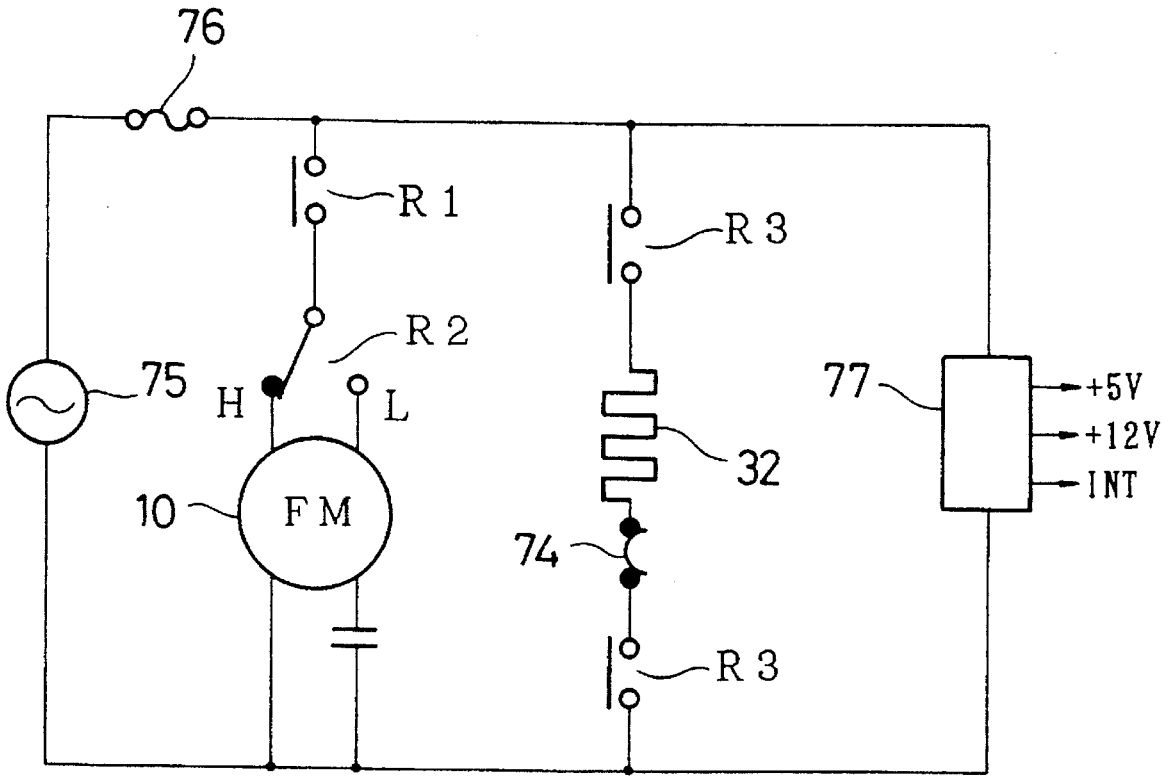
FIG. 34 is another circuit diagram of the control circuit of a ventilator/dryer assembly according to the invention.

FIG. 33 is a circuit diagram of the control circuit for controlling the operation the embodiment by means of the above wired remote control unit and FIG. 34 shows an alternative circuit diagram of the control circuit. Referring to FIGS. 33 and 34, it is designed to control a humidity sensor 71 arranged near the air inlet port of the grille 103, a protection sensor 72 that stops the operation of the apparatus upon detecting any abnormal temperature in exhaust air, a solenoid 73 of a stepping motor (not shown) for driving the damper 8, a bimetal 74 for opening the power supply circuit of the electric heater (PTC heater) 32 whenever the heater shows extraordinary high temperature, a drive power source (AC 100 V) 74, an electric fuse 76 and a power source 77 for feeding the different mechanisms of the apparatus.

Figure 35:
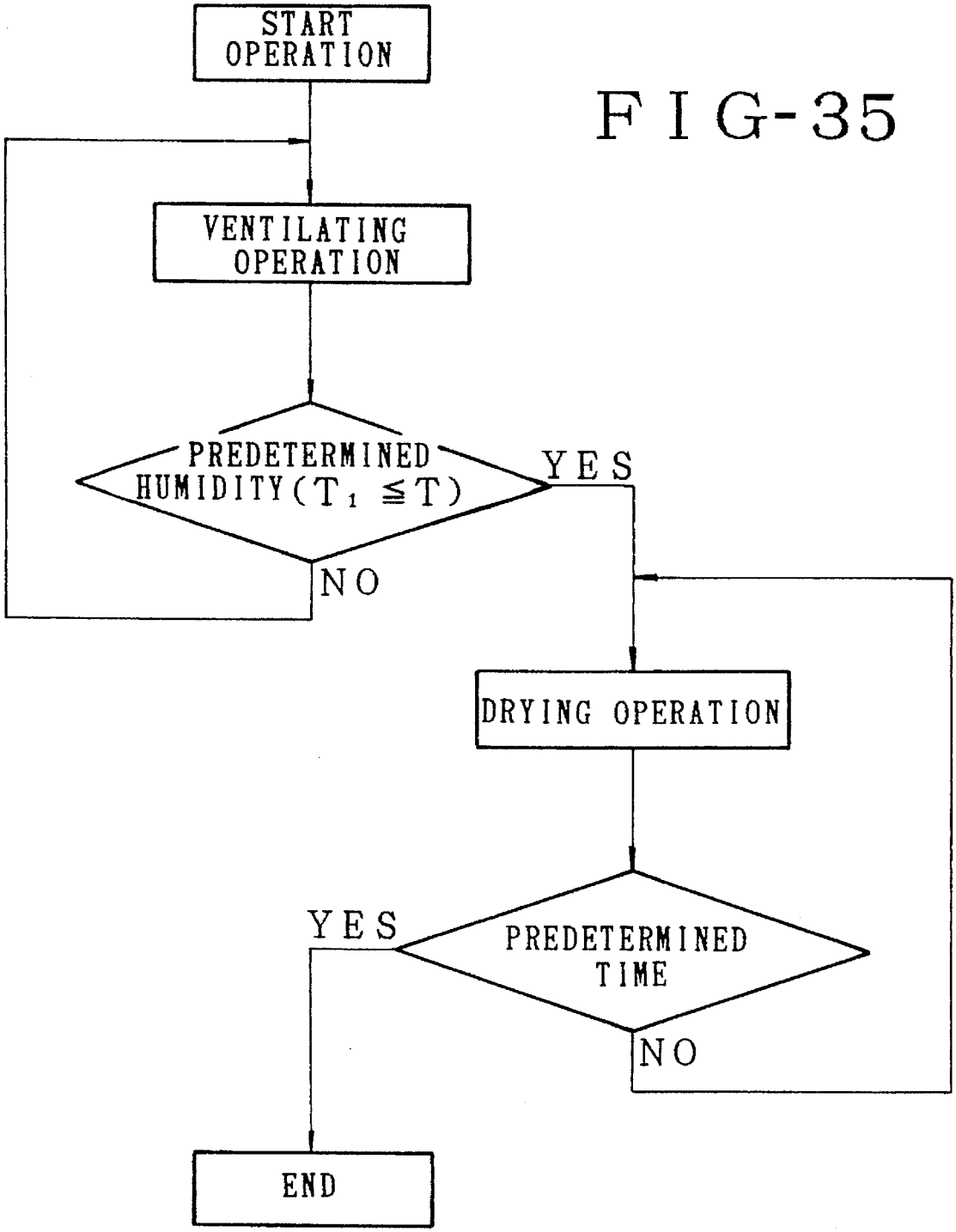
FIG. 35 is a flow chart for switching the operation of a ventilator/dryer assembly according to the invention from the ventilation mode to the drying mode.

The wired remote control unit 60 operates to switch from the ventilation mode to the drying mode or vice versa in a manner as described below by referring to the flow chart of FIG. 35. Assume that the automatic (AUTO) operation switch 61B is turned on and an operation of two hours is selected by using the timer selection switch 61E.

Then, the apparatus starts operating and the solenoid 73 of the damper drive motor is energized to drive the damper to block the communication opening 6 between the lead-in path 5 guiding wet air A from the room and the primary side section 7A of the treatment chamber 7 and opening the vent 9 so that wet air drawn out of the room into the lead-in path 5 of the case main body 1 by the blower 10 is directly discharged through the vent 9. (Note that the air discharging mode indicator 62A and the timer indicator 2C2 flash under this condition).

At the same time, relay switch R1 is turned on by micro-computer 81 by way of buffer 82 connected thereto to drive the blower 10 at low speed (L) under the control of relay switch R2 that is also turned on.

As the apparatus operates in the air discharging mode, the humidity T1 in the bathroom 100 falls and, when the humidity sensor 71 senses that T1 is lower than a predetermined humidity level T (T1<=), the solenoid 73 of the damper 8 is energized again to drive the latter to open the communication opening 6 and, at the same time, close the vent 9 so that wet air A from the room is led into the primary side section 7A of the treatment chamber 7 via the communication opening 6 and the apparatus operates in the drying operation mode.

Under this condition, the air discharging mode indicator 62A is turned off and the drying mode indicator 62B starts flashing. At the same time, relay switch R3 is turned on to energize the electric heater 32 and, at the same time, the relay switch R2 is turned on again to shift the operation of the blower 10 to high speed operation (H).

When a duration of two hours is over, the apparatus automatically stops operating in the drying mode.

Figure 36:
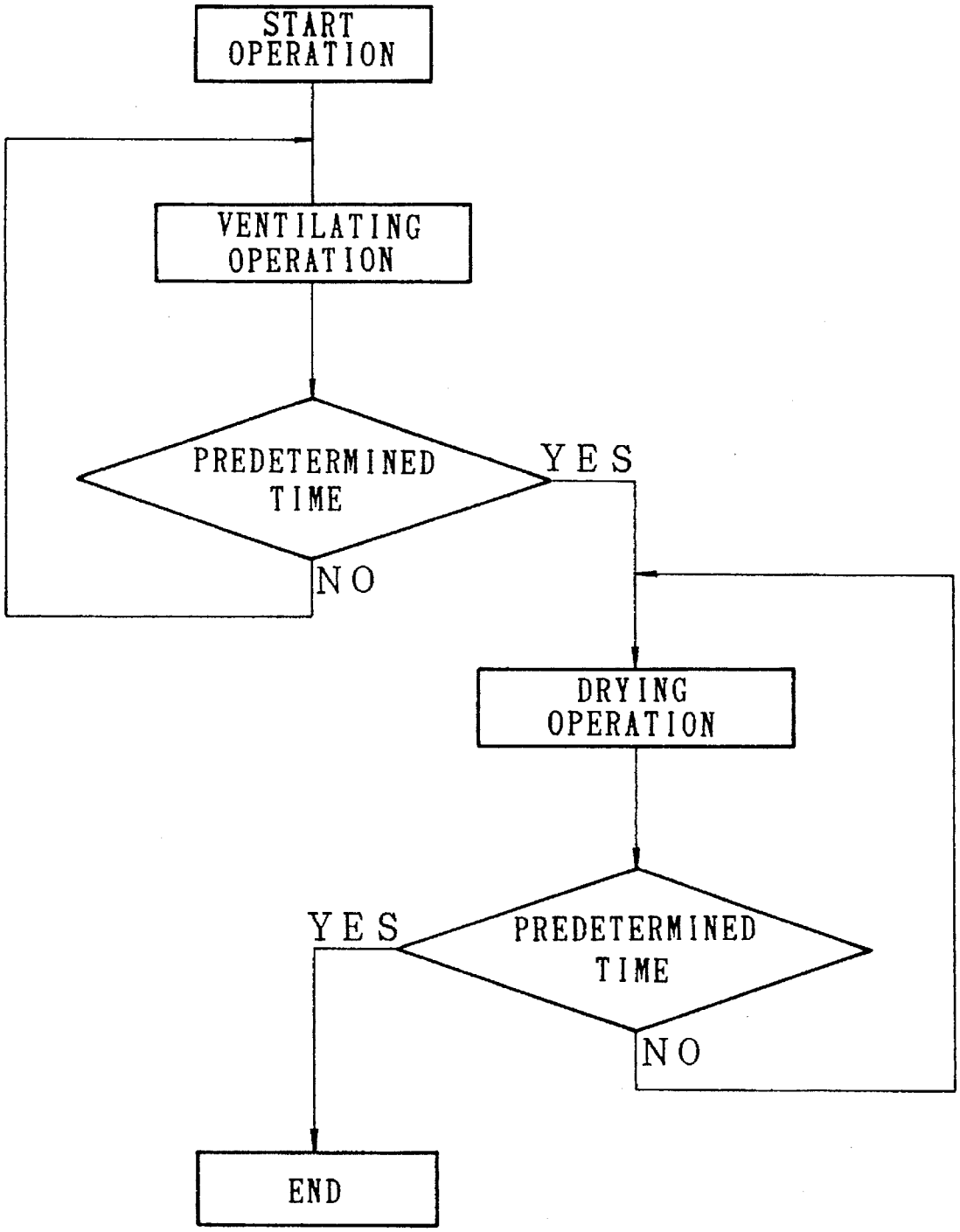
FIG. 36 is another flow chart for switching the operation of a ventilator/dryer assembly according to the invention from the ventilation mode to the drying mode.
Figure 37:
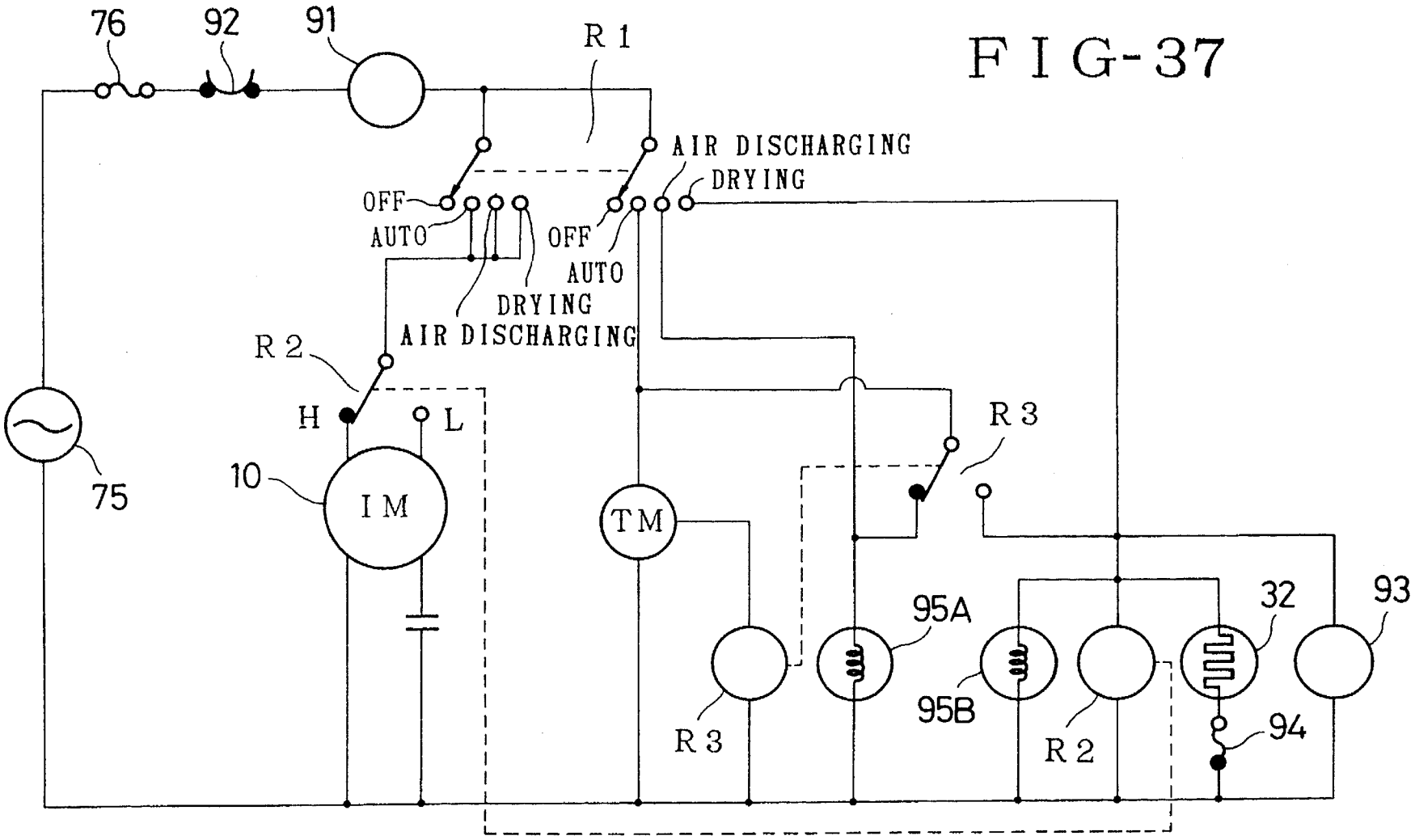
FIG. 37 is another circuit diagram of the control circuit of a ventilator/dryer assembly according to the invention.

FIG. 36 shows a flow chart of an alternative operation of switching from the air discharging operation mode to the drying operation mode of the wired remote control unit and FIG. 37 shows a circuit diagram of the control circuit for the operation. Here, the humidity sensor of FIG. 33 is replaced by a timer relay TM that makes the apparatus operate in the air discharging operation mode for a predetermined period of time (e.g., 30 minutes). The circuit is designed to control a clockwork type OFF timer 91 for selecting an overall operation time, a bimetal 92 for opening the power supply circuit of the blower whenever it senses extraordinary high temperature in the air being discharged, a solenoid 93 of a stepping motor (not shown) for driving the damper 8, an electric fuse 94 for opening the power supply circuit of the electric heater (PTC heater) 32 whenever it shows extraordinary high temperature, an air discharging operation indicator 95A and a drying mode operation indicator 95B, each of said indicators containing an incandescent lamp. An induction motor IM is used for the blower 10.

Now, another embodiment of ventilator/dryer assembly according to the invention will be described by referring to FIGS. 38 through 44.

As shown in FIGS. 38 through 42, it has a rectangularly parallelepipedic case main body 201 comprising a front panel 202 to be placed vis-a-vis the wall of a room such as a bathroom 100, a bottom panel 203, a rear panel 204, a pair of lateral panels 205, 206 and a top panel 207, of which said front panel 202, said bottom panel 203, said rear panel 204 and said lateral panels 205, 206 are separably assembled.

A joint section 208 is projecting frontward from the center of said front panel 202 and an air inlet port 209 and an air outlet port 210 are vertically arranged side by side within said joint section 208 so that air can be drawn in and blown out through a single limited area on a single side of the case main body 201. The joint section 208 of the case main body 201 is so dimensioned that it can be easily tightly fitted from the outside into the frame 102 of an existing vent arranged on a wall 101 of a bathroom 100 of a building with the joint section 208 directed to the inside of the room. It may typically have a height and a width of 150 mm×200 mm.

The inside of the case main body 201 is divided into a primary zone 210A communicating with the air inlet port 209 in the joint section 208, a secondary zone 201B for receiving wet air A from the room 100 by means of a forced circulation mechanism 220 comprising a centrifugal type blower 221 such as a sirocco fan arranged in said primary zone 201A and a tertiary zone 201C for receiving dry air B obtained by removing moisture out of wet air in said secondary zone 201B by means of a drying mechanism 230 comprising a rotary drying device 231 designed to adsorb moisture and discharging dry air B into said room 100 through said air outlet port 210, said zones being separated from each other by partitions 211, 212 and 213 respectively.

More specifically, said primary zone 201A and said secondary zone 201B are separated by said first partition 211 and said secondary zone 201B and said tertiary zone 201C are separated by said second partition 212 so that wet air A in the bathroom 100 is drawn in via said air inlet port 209 and made to sequentially pass through said primary zone 201A, said secondary zone 201B and said tertiary zone 201C and blown back into said room 100 via said air outlet port 210 by means of said blower 221, while said rotary drying device 231 is located between said secondary zone 201B and said tertiary zone 201C and adsorbs moisture in wet air A made to pass therethrough by the blower 221.

The inlet 222 of the blower 221 of the forced circulation mechanism 220 disposed at the front end of the blower 221 faces said primary zone 201A and the outlet 223 of the blower 221 faces said secondary zone 201B, while the drive motor 224 which is integral with the blower and arranged at the back of the latter is located within a quaternary zone 201D defined by the first partition 211 and a fourth partition 214.

The rotary shaft 01 of said blower 221 and the rotary shaft O2 of the rotary drying device 231 of the drying mechanism 230 are juxtaposed and located on a same horizontal plane relative to the front panel 202 of the case main body 201 to be placed vis-a-vis the wall of the room 100 and the frontal plane of said inlet 222 of said blower 221 is arranged obliquely relative to the frontal plane of said air inlet port 209 so that the case main body 201 may have reduced length and width as viewed from the front panel 202.

The case main body 201 additionally comprises a fifth partition 215 horizontally arranged at a lower portion of the primary zone 201A to separate the primary zone 201A and the tertiary zone 201C with the partitions 211 and 213. The case main body 201 also comprises a sixth partition 216 arranged to form a path for dry air B in the tertiary zone 201C to be blown back into the room 100 through said air outlet port 210.

A blow-out nozzle 225 is formed by utilizing a part 214*a* of the fourth partition 214 and connected to the outlet 223 of said blower 221. Said nozzle 225 has an outlet 226 facing said secondary zone 201B and a wall 225*a*, which is arranged opposite to the rear panel 204 of the case main body 201 and carriers an air discharge opening 227 disposed vis-a-vis a vent 204*a* formed in the rear panel 204.

The blower 221 is unitized with the first partition 211 separating the primary zone 201A, the secondary zone 201B and the quaternary zone 201D and the blow-out nozzle 225 realized by utilizing a part 214*a* of the fourth partition 14, whereas the rotary drying device 231 is unitized with the second partition 212 separating the secondary zone 201B and the tertiary zone 201C. The units can be removed out of the case main body 201 by pulling them upward after removing the top panel 207 from the case main body 201.

The case main body 201 additionally comprises a first guide section 217 formed by a recess of the fifth partition 215 arranged at a lower portion of the primary zone 201A and paired second guide sections 218, 218 formed by arranging a pair of L-shaped pieces on the bottom panel 203 of the case main body 201. The first guide section 217 is designed to engagedly receive the lower end 221*a* of the blower 221 unitized with said first partition 211, while the second guide sections 218, 218 engagedly receive the lower end 212*a* of the second partition 212 unitized with the rotary drying device 231 so that the both units may be placed in position accurately and efficiently before they are secured in position by means of screws.

The case main body 201 further comprises a damper disposed within the nozzle 225 that can be rotated by means of a step motor 229. Said damper 228 is so controlled as to block the air discharge opening 227 of the blow-out nozzle 225 in the drying mode of operation and the outlet 226 of the nozzle 225 in the ventilating mode of operation. Thus, the embodiment can operate as a ventilator that draws wet air A out of the room 100 through the air inlet port 209, makes it pass through the primary zone 201A and the secondary zone 201B and blows it back into the room 100 via the air discharge opening 227 and the vent 204*a* by means of the blower 221 of the forced circulation mechanism 220.

The fourth partition 214 is provided with a first ventilation hole 219A for making the secondary zone 201B communicate with the quaternary zone 201D, whereas the first partition 211 is provided with a second ventilation hole 219B for making the primary zone 201A communicate with the quaternary zone 201D. With this arrangement, part of wet air A introduced into the secondary F zone 201B from the room 100 is fed to the quaternary zone 201D and then back to the primary zone 201A by means of the forced circulation mechanism 220 so that the drive motor 224 of the blower 221 arranged in the quaternary zone 201D may be cooled by the circulating air.

The rotary drying device 231 of the drying mechanism 230 may be same as the one used in the first embodiment and therefore it will not be described here any further.

A first shell (regenerating shell) 241 is arranged in the tertiary zone 201C at a position corresponding to the regenerating position 231B and the heat recovering position 231C of the rotary drying device 231 and contains therein, as shown in FIG. 42, a partition 242 that defines a lead-in path 243 for a branched flow of dry air from the heat recovering position 231C of the rotary drying device 231 and a lead-out path 244 for turning the branched flow of dry air round toward the regenerating position 231B of the rotary drying device 231. An electric heater 245 which is a sheathed heater (PTC heater) is arranged at the junction of the lead-in path 243 and the lead-out path 244 and its rectangular heating surface 245*a* that allows air to pass therethrough is disposed vis-a-vis the regenerating position 231B of the rotary drying device 231.

Then, in the secondary zone 201B, a second shell (air discharging shell) 546 is arranged vis-a-vis the lead-out path 244 of the first shell 241 at a position corresponding to the regenerating position 231B of the rotary drying device 231 and an exhaust pipe 247 is connected to the bottom of the second shell 246, said exhaust pipe 247 being exposed to the outside through the bottom of the case main body 201.

Thus, the flow of wet air A introduced into the secondary zone 201B through the primary zone 201A by the blower 221 is branched and made to flow through the heat recovering position 231C of the rotary drying device 231 so that moisture is adsorbed there as in the case of the air flow shown in FIG. 6. Then, the branched air flow is made to pass through the lead-in path 244 of the first shell 241 and turned round to run in a direction opposite to the flow of wet air A toward the regenerating position 231B at the junction, where air is heated by the PTC heater 245 so that hot regenerating air may pass through the rotary drying device 231 in the regenerating position 231B and hence regenerate the rotary drying device 231.

Air D that has been used for regenerating the rotary drying device 231 is then discharged from the bottom of the case main body 201 through the exhaust pipe 247 connected to the second shell 246, while dry air B that has passed through the rotary drying device 231 in the drying position 231A is blown back into the room 100 through the tertiary zone 201C and the air outlet port 210 until the inside of the room 100 is satisfactorily dried.

Note that the heat recovering position 231C of the rotary drying device 231 allows wet air A stored in the secondary zone 201B to pass therethrough and cool the rotary drying device 231 that has been heated in the regenerating position 231B. The capacity of the PTC heater 245 for heating regenerating air C in the heat recovering position 231C may typically be 450 W, which is sufficient to heat dry air B to be blown back into the room 100 through the air outlet port 210 to a temperature higher than the room temperature by about 6 degrees.

Figure 44:
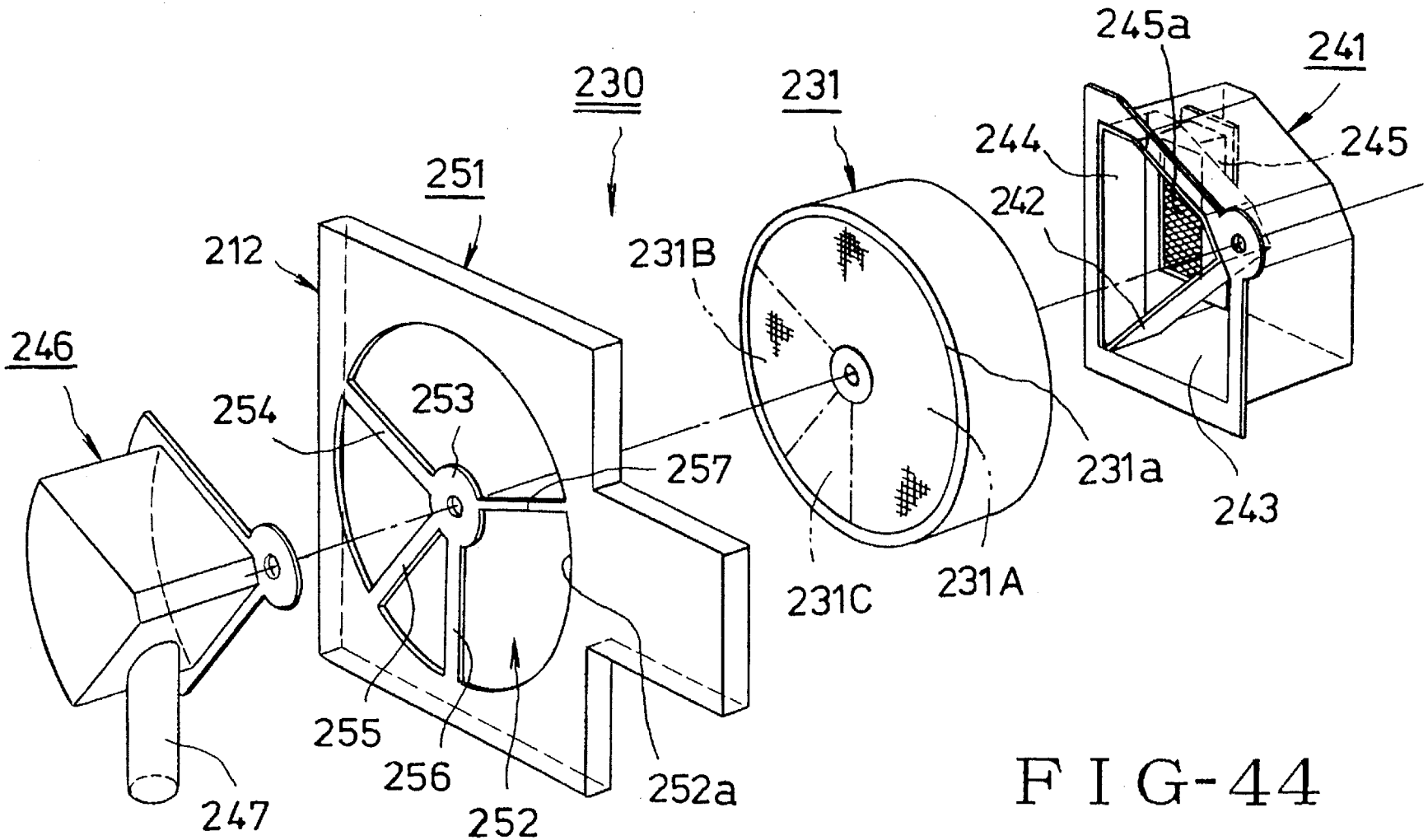
FIG. 44 is an exploded schematic perspective view of the rotary drying device of a ventilator/dryer assembly according to the invention.

As shown in FIG. 44, the rotary drying device 231 is rotatably supported by a stainless steel sealing panel member 251 having a thickness of about 1.2 mm that also operates as the second partition 212 separating the secondary zone 201B and the tertiary zone 201C in the case main body 201. The sealing panel member 251 is also provided with a ventilation hole 252 having a diameter smaller than that of the rotary drying device 231 (e.g., 20 cm). Thus, the rotary drying device 231 can be fitted into the ventilation hole 252 in such a way that the inner periphery 252*a* of the ventilation hole 252 is airtightly held in contact with the outer periphery 231*a* of the rotary drying device 231 with the front side of the device 231 facing the secondary zone 201B.

The sealing panel member 251 has a bearing 253 for holding shaft of the rotary drying device 231 at the center of the ventilation hole 252, said bearing 253 being supported by arms 254, 255, 256 radially extending from the bearing 253 to the inner periphery 252*a* of the ventilation hole 252 to divide the circular hole into sectors corresponding to the drying position 231A, the regenerating position 231B and the heat recovering position 231C of the rotary drying device 231, the sector defined by the radial arms 254 and 256 and corresponding to the drying position 231A of the rotary drying device 231 being divided by a reinforcing arm 257 also extending from the bearing 253 to the inner periphery 252 of the ventilation hole 252.

The reinforcing arm 257 is provided to prevent the sealing panel member 251 from being deformed by heat emitted from the heated rotary drying device 231 and maintain the airtight connecting between the outer periphery 231*a* of the rotary drying device 231 and the inner periphery 252*a* of the ventilation hole 252 of the sealing panel member 251 and hence the drying effect of the apparatus. Additionally, the reinforcing arm 257 allows the sealing panel member 251 to be made relatively thin to reduce the weight of the unit.

Figure 38:
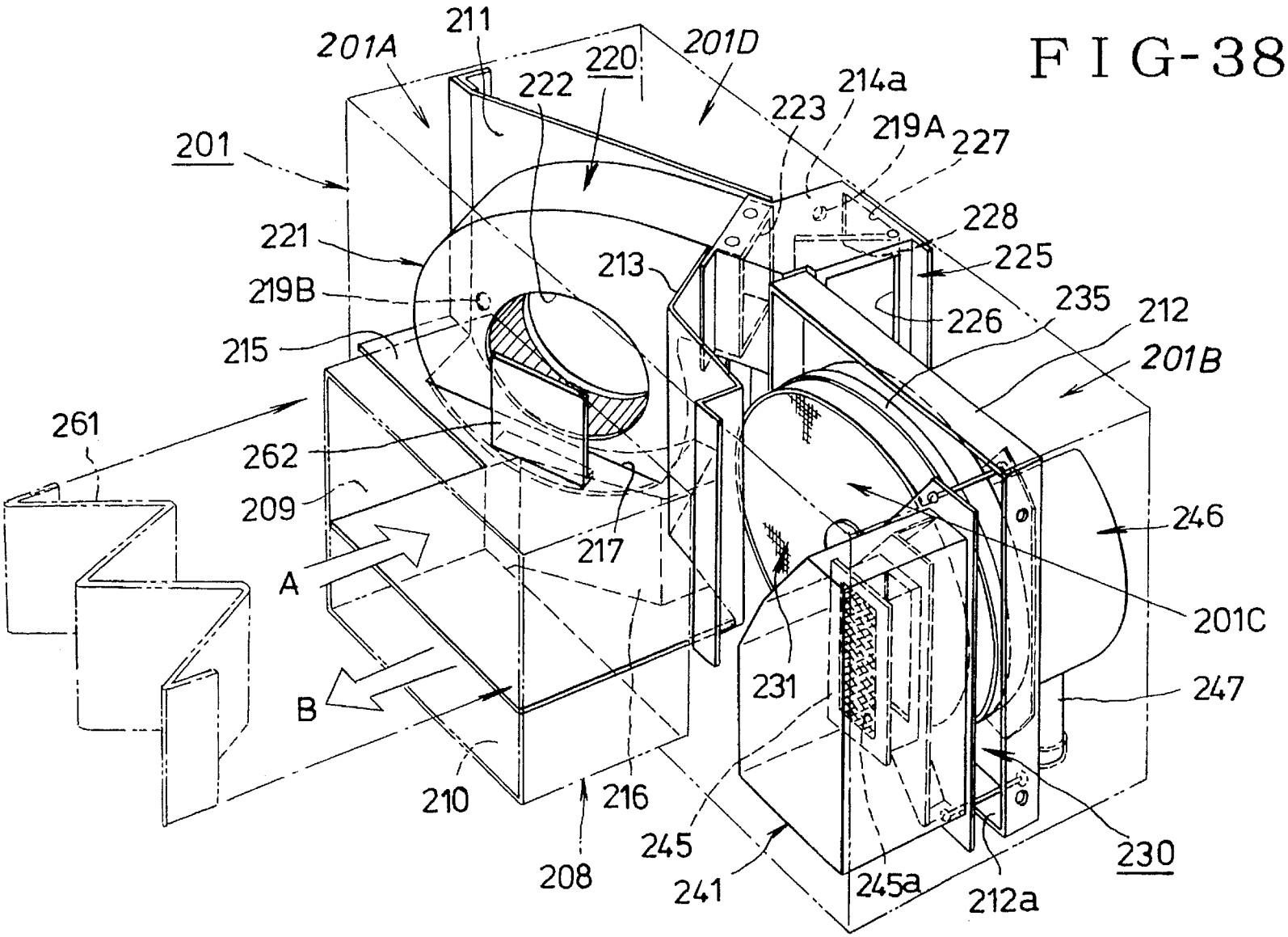
FIG. 38 is a schematic perspective view of another embodiment of ventilator/dryer assembly according to the invention as viewed from the front side.
Figure 39:
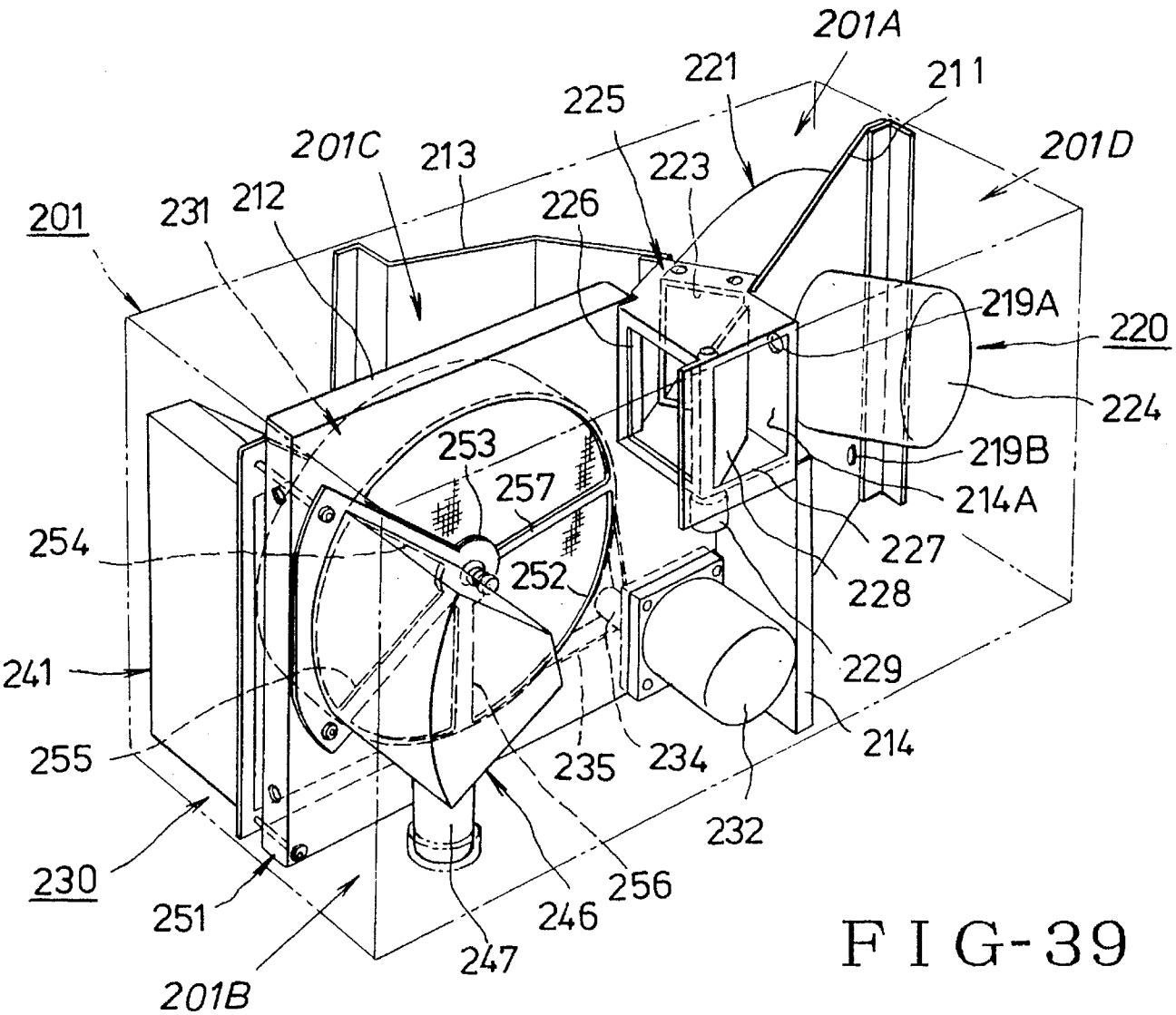
FIG. 39 is a schematic perspective view of another embodiment of ventilator/dryer assembly according to the invention as viewed from the rear side.
Figure 40:
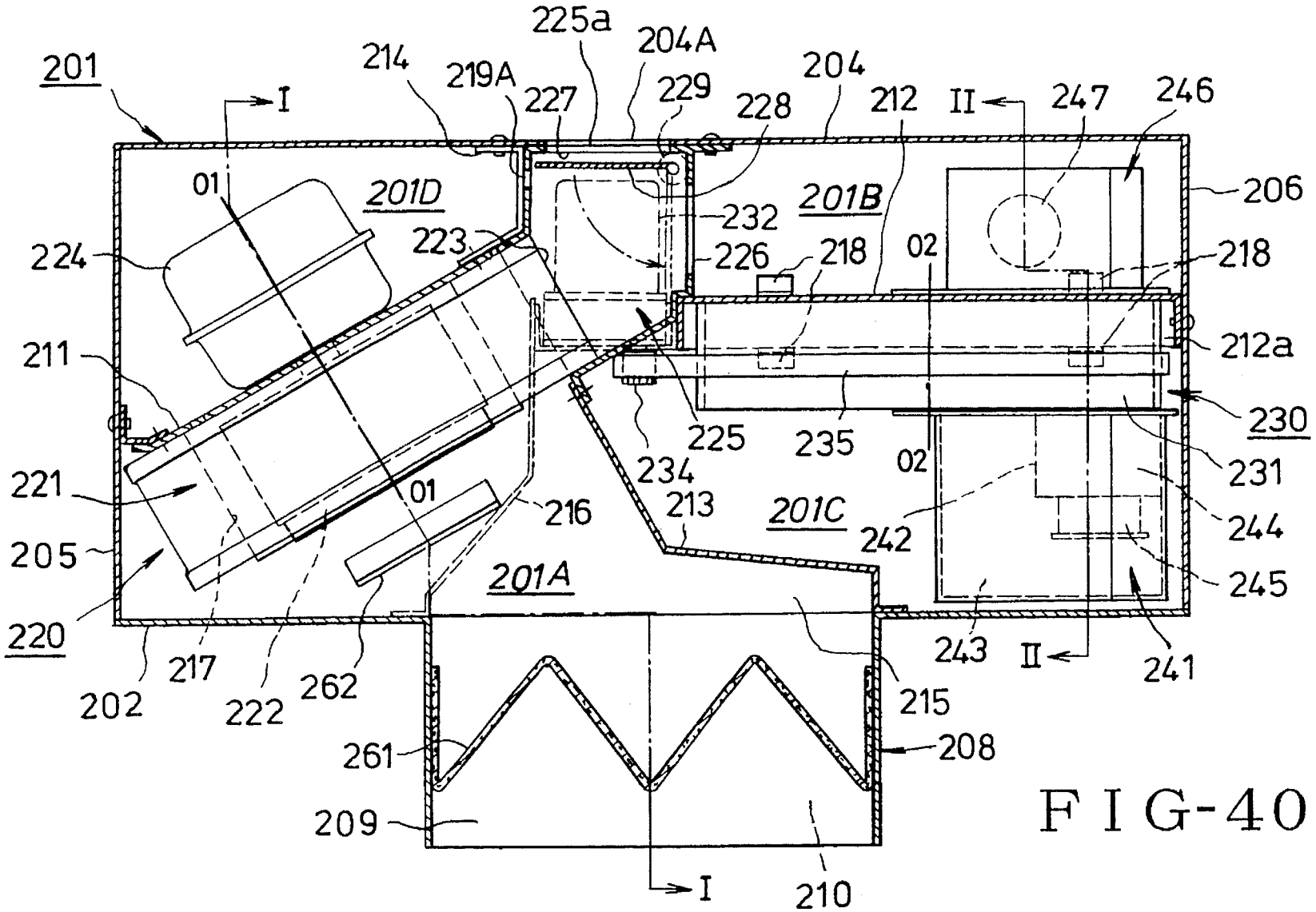
FIG. 40 is a schematic transversal cross sectional view of the embodiment of FIG. 39.
Figure 43:
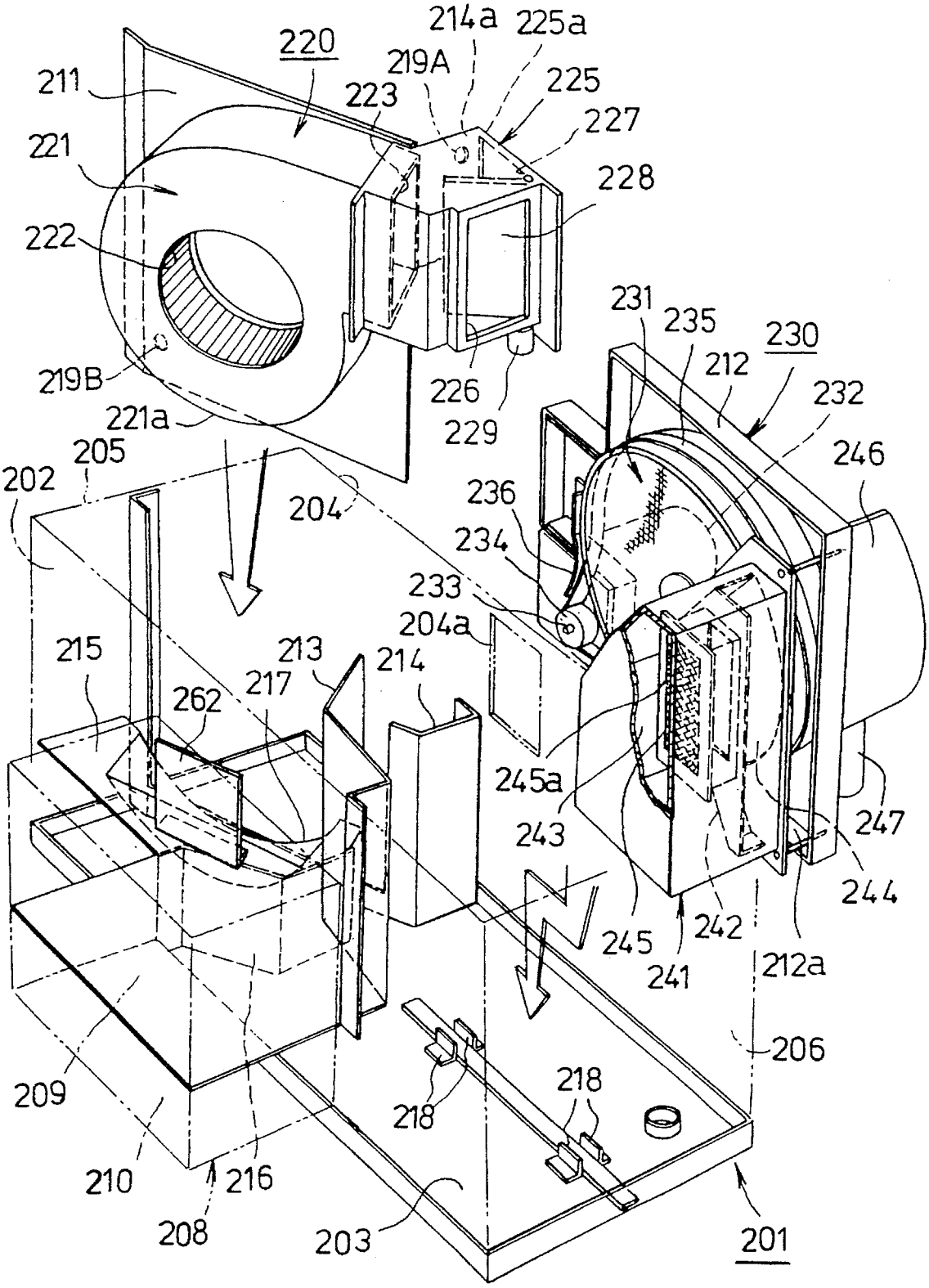
FIG. 43 is an exploded schematic perspective view of a ventilator/dryer assembly according to the invention, showing the blower unit and the rotary drying device taken out of the housing.

The case main body 201 additionally comprises an air filter 261 arranged in the air inlet port 209 in the joint section 208, which air filter 261 is corrugated as illustrated in FIGS. 38, 40 and 41 to maximize the surface area and hence the filtering capacity thereof. Such a configuration of the air filter 261 is also effective to absorb noises generated by the blower 221 and other components in the inside of the case main body 201 that may otherwise be emitted through the air inlet port 209.

The case main body 201 further comprises a sound insulating member 262 arranged on the fifth partition 215 in the primary zone 201A in the case main body 201, which sound insulating member 262 is located between the air inlet port 209 in the case main body 201 and the inlet 222 of the blower 21 such that noises generated by the blower 221 in operation can be effectively prevented from being emitted through the inlet of the blower 221 to the outside.

Note that the blower 221 and the rotary drying device 231 of the above embodiment that are the heaviest components of the apparatus are arranged substantially symmetrically in the case main body 201 so that the entire apparatus can seldom lose its balance.

In order to improve the effect of sterilizing the air and the washed cloths in the room, an ozone generator (not shown) arranged within the tertiary zone 201C of the case main body 201 so that ozone can be blown into the room with dry air B.

ADVANTAGES OF THE INVENTION

As described above in detail, with a ventilator/dryer assembly for drying wet air comprising a treatment chamber in the case main body, since the treatment chamber is divided into a primary side section and a secondary side section with a rotary drying device disposed therebetween and a forced circulation mechanism housed is provided to cause air drawn from the air inlet port to pass through the lead-in path, the secondary side section of the treatment chamber and the rotary drying device and since the rotary drying device is arranged in such a way that it can take a drying position for causing the rotary drying device to adsorb moisture out of wet air passing therethrough, a regenerating position for causing hot air to pass through the rotary drying device that has adsorbed moisture in order to remove the moisture and a heat recovering position for cooling the rotary drying device by causing air to pass through the device that has been heated in the regenerating position, the operation of drying wet air in the room where the assembly is installed by means of the rotary drying device and that of regenerating the rotary drying device can be carried out on a continuous basis in the drying mode of operation.

Additionally, since the forced circulation mechanism of the ventilator/dryer assembly comprises a single blower that draws and discharges air both for air circulation in the room and for regeneration of the rotary drying device, the overall configuration of the ventilation system of the room can be simplified for downsizing to realize a lightweight apparatus at reduced cost.

When air fed to the rotary drying device in said drying position and air fed to the device in said regenerating position are oppositely directed in a ventilator/dryer assembly according to the invention as described above by referring to the second aspect of the invention, the rotary drying device can be cleaned automatically without difficulty.

When a guide path is provided in said case main body to guide air drawn from the room through the air inlet port to the primary side section of the treatment chamber and a damper is provided downstream to the guide path to discharge wet air directly out of said case main body without passing it through said treatment chamber in a ventilator/dryer assembly according to the invention as described above by referring to the third aspect of the invention, the operation of ventilating the room and that of drying it can be carried out independently and sequentially to improve the efficiency of drying the room and consequently reduce the time required for drying washed cloths.

If a regenerating shell is arranged in the secondary side section of said treatment chamber and provided with heating means for heating air collected from said heat recovering position in order to apply heated air to the rotary drying device in the regenerating position and an air discharging shell is arranged in the primary side section of said treatment chamber as an air discharging mechanism for discharging hot air out of said case main body collected from said regenerating position, said regenerating shell and said air discharging shell being disposed vis-a-vis with said rotary drying device located therebetween, in a ventilator/dryer assembly according to the invention as described above by referring to the fourth aspect of the invention, hot air to be discharged from the ventilator/dryer assembly is prevented from being fed again to the rotary drying device and therefore the moisture adhering to the rotary drying device can be efficiently removed. Consequently, the entire room where the ventilator/dryer assembly is installed can be dried effectively and efficiently.

If a lead-in path for a branched air flow coming from the heat recovering position of said rotary drying device and a lead-out path for turning the branched air flow round toward the regenerating position are formed in said regenerating shell and separated from each other by a partition and an electric heater is arranged at the junction of the lead-in path and the lead-out path, the blowing and heating side of the electric heater being disposed vis-a-vis the regenerating position of said rotary drying device, in a ventilator/dryer assembly according to the invention as described above by referring to the fifth aspect of the invention, the width of the regenerating shell can be reduced and consequently the entire ventilator/dryer assembly may be significantly downsized.

Since air to be used in the heat recovering position is obtained by branching the flow of air fed to the drying position and the air that has been heated in the heat recovering position is used for the regenerating position, the operation of heating regenerating air can be carried out efficiently. Consequently, a low capacity heater may be used for the purpose of the invention. The use of air obtained by branching the flow of air fed from the room as regenerating air can significantly reduce the contamination of the rotary drying device as compared with a comparable conventional apparatus that use ambient air as regenerating air.

With a ventilator/dryer assembly for drying wet air comprising a treatment chamber, a rotary drying device and a forced circulation mechanism housed in a case main body provided with an air inlet port and an air outlet port exposed to the outside as described above by referring to the ninth aspect of the invention, the operation of drying the inside of the room where it is installed can be carried out efficiently to significantly reduce the rate of consuming energy and consequently the time required for drying washed cloths can be greatly reduced because it further comprises an air discharging mechanism for directly discharging air in the room and therefore air can be selectively forced out of the room before it is caused to pass through the rotary drying device by means of the forced circulation mechanism.

If an operation control mechanism is provided for causing the air discharging mechanism to directly discharge air taken in by said forced circulation mechanism before applying it to said rotary drying device, until the relative humidity in ambient air is reduced to a predetermined level or for a predetermined period of time before applying it to said rotary drying device in a ventilator/dryer assembly according to the invention as described above by referring to the ninth aspect of the invention, the operation of ventilating and/or drying the inside of the room can be carried out more efficiently.

With a ventilator/dryer assembly for drying wet air comprising a rotary drying device and a forced circulation mechanism housed in a case main body provided with an air inlet port and an air outlet port exposed to the outside as described above and characterized in that said case main body is divided at least into a primary zone held in communication with said air inlet port, a tertiary zone held in communication with said air outlet port and a secondary zone arranged adjacent to said primary and tertiary zone and said ventilator/dryer assembly further comprises a blower unit comprising a centrifugal type blower for circulating air from said air inlet port sequentially through said primary, secondary and tertiary zones to said air outlet port and said rotary drying device is arranged between said secondary and tertiary zones to adsorb moisture out of air brought to contact with it form a specifically designed air flow path, the overall configuration of the ventilation system of the room can be further simplified for downsizing.

If said case main body is further divided to form a quaternary zone arranged adjacent to said primary and secondary zone with said air inlet port of the blower of said blower unit facing said primary zone with the drive motor of said blower disposed in said quaternary zone and a cooling path is provided to for directing part of air blown out of said primary zone toward said secondary zone to said quaternary zone and then discharging into the primary zone in a ventilator/dryer assembly as according to the invention and described above by referring to the preceding aspect of the invention, the blower unit can be effectively and efficiently cooled while the ventilator/dryer assembly is in operation.

If said blower unit and said rotary drying device are arranged in juxtaposition in such a way that their rotary shafts are found on a same horizontal plane relative to the side of said case main body for interacting with the inside of the room in a ventilator/dryer assembly according to the invention as described above by referring to the preceding aspect of the invention, the width of the case main body of the ventilator/dryer assembly as viewed from the side thereof for interacting with the inside of the room can be significantly reduced.

If the blower and the rotary drying device are fitted to the respective partitions dividing the inside of the case main body into a primary zone, a secondary zone and a tertiary zone, the blower and the rotary drying device can be securely held in position.

If, finally, said blower unit is fitted to said partition panel separating said primary and secondary zones and said rotary drying device is fitted to said partition panel separating said secondary and tertiary zones so that said blower unit and said rotary drying device are realized in the form of removable units combined with the respective partition panels in a ventilator/dryer assembly according to the invention as described above by referring to the preceding aspect of the invention, both the blower unit and the rotary drying device can be fitted to and removed from the case main body with ease and held stably in position so that the entire ventilator/dryer assembly can be serviced without difficulty.

What is claimed is:

1. A ventilator/dryer assembly for drying wet air in a room comprising:

a forced circulation mechanism housed in a case main body provided with an air inlet port and an air outlet port that communicates with the interior of the room;

a treatment chamber in said main body divided into a primary side section and a secondary side section;

a rotary drying device disposed between said primary and secondary side sections, the forced circulation mechanism comprising a single blower for drawing air from said air inlet port to the primary side section of the treatment chamber, passing it through the rotary drying device and sending it back into the room through the secondary side section of the treatment chamber and the air outlet port;

the rotary drying device having a drying position, a regenerating position and a heat recovering position sequentially in the sense of rotation, the rotary drying device adsorbing moisture from the air passing therethrough from the primary side section of said treatment chamber in the drying position, hot air being made to pass through the rotary drying device in the regenerating position to remove moisture adsorbed by the device in said drying position, cooled air being made to pass through the heated device in the heat recovering position to cool the device heated in said regenerating position, wherein said inlet port is disposed above said air outlet port and a guide path is provided in said case main body to guide air drawn from the room through the air inlet port to the primary side section of the treatment chamber and a damper is provided downstream to the guide path to discharge wet air directly out of said case main body without passing it through said treatment chamber.

2. A ventilator/dryer assembly for drying wet air in a room comprising:

a forced circulation mechanism housed in a case main body provided with an air inlet port and an air outlet port that communicates with the interior of the room;

a treatment chamber in said main body divided into a primary side section and a secondary side section;

a rotary drying device disposed between said primary and secondary side sections, the forced circulation mechanism comprising a single blower for drawing air from the room where the ventilator/dryer assembly is installed via said air inlet port to the primary side section of the treatment chamber, passing it through the rotary drying device and sending it back into the room through the secondary side section of the treatment chamber and the air outlet port; the rotary drying device having a drying position, a regenerating position and a heat recovering position sequentially in the sense of rotation, the rotary drying device adsorbing moisture from the air passing therethrough from the primary side section of said treatment chamber in the drying position, hot air being made to pass through the rotary drying device in the regenerating position to remove moisture adsorbed by the device in said drying position, cooled air being made to pass through the heated device in the heat recovering position to cool the device heated in said regenerating position a regenerating shell arranged in the secondary side section of said treatment chamber and provided with heating means for heating air collected from said heat recovering position to apply heated air to the rotary drying device in the regenerating position and an air discharging shell arranged in the primary side section of said treatment chamber as an air discharging mechanism for discharging hot air out of said case main body collected from said regenerating position, said regenerating shell and said air discharging shell being disposed with said rotary drying device located therebetween; wherein the surface area of the rotary drying device adapted for an air flow in said drying position is equal to or greater than the surface area of the rotary drying device adapted for an air flow in said regenerating position and the surface area of the rotary drying device adapted for an air flow in said heat recovering position is equal to or smaller than the surface area of the rotary drying device adapted for an air flow in said regenerating position.

3. A ventilator/dryer assembly for drying wet air in a room (100) comprising:

a forced circulation mechanism (10) housed in a case main body (1) provided with an air inlet port (3) and an air outlet port (4) to communicate with the interior of the room (100);

a drying mechanism (20) including a rotary drying device for drying wet air taken in by the forced circulation mechanism (10) through said inlet port (3);

a regeneration mechanism (31) for removing moisture out of the rotary drying device;

an air discharging mechanism (8,9) located between said air inlet port and said drying mechanism for directly discharging air taken in through the inlet port (3) to a location outside the room; and an operation control mechanism (60) for causing the air discharging mechanism (8,9) to directly discharge air taken in by said forced circulation mechanism (10) before it can be applied to said rotary drying device (20) until the relative humidity in ambient air is reduced to a predetermined level.

4. A ventilator/dryer assembly for drying wet air in a room (100) comprising:

a forced circulation mechanism (10) housed in a case main body (1) provided with an air inlet port (3) and an air outlet port (4) to communicate with the interior of the room (100);

a drying mechanism (20) including a rotary drying device for drying wet air taken in by the forced circulation mechanism (10) through said inlet port (3);

a regeneration mechanism (31) for removing moisture out of the rotary drying device;

an air discharging mechanism (8,9) located between said air inlet port and said drying mechanism for directly discharging air taken in through the inlet port (3) to a location outside the room; and an operating control mechanism (60) for causing the air discharging mechanism (8,9) to directly discharge air taken in by said forced circulation mechanism (10) to a location outside the room before it can be applied to said rotary drying device (20) for a predetermined period of time and the discharged air does not pass through said rotary drying device during the predetermined period of time that the air discharge mechanism is directly discharging air taken in by said forced circulation mechanism (10) to a location outside the room.

5. A ventilator/dryer assembly for drying wet air in a room comprising:

a rotary drying device and a forced circulation mechanism housed in a case main body to be located outside of the room and provided with an air inlet port and an air outlet port to communicate with the interior of the room;

said case main body divided at least into a primary zone in communication with said air inlet port, a tertiary zone in communication with said air outlet port and a secondary zone arranged adjacent to said primary and tertiary zone;

a blower unit comprising a centrifugal type blower for circulating air from said air inlet port sequentially through said primary, secondary and tertiary zones to adsorb moisture out of air brought into contact with it, the rotary shaft of said blower unit and that of said rotary drying device being arranged in the part of said case main body which is outside of the room.

6. A ventilator/dryer assembly for drying wet air in a room comprising:

a rotary drying device and a forced circulation mechanism housed in a case main body to be located outside of the room and provided with an air inlet port and an air outlet port to communicate with the interior of the room;

said case main body divided into a primary zone in communication with said air inlet port, a tertiary zone in communication with said air outlet port, a secondary zone arranged adjacent to said primary and tertiary zones, and a quaternary zone arranged adjacent to said primary zone and secondary zone;

a blower unit comprising a centrifugal type blower for circulating air from said air inlet port sequentially through said primary, secondary and tertiary zones to said air outlet port, and said rotary drying device arranged between said secondary and tertiary zones to adsorb moisture from air brought into contact with it, the inlet of said blower of said blower unit being exposed to said primary zone, said blower unit being provided with a drive motor arranged in said quaternary zone, a flow path for cooling air being established to feed part of air flowing to the secondary zone from the primary zone into said quaternary zone and then to the primary zone.

7. A ventilator/dryer assembly according to claim 6, wherein the rotary shaft of said blower unit and that of said rotary drying device is located in the part of said case main body that is outside of the room.

8. A ventilator/dryer assembly according to claim 7, wherein said primary zone and said secondary zone, and said secondary zone and said tertiary zone are separated by respective partition panels, said blower unit being fitted to said partition panel separating said primary and secondary zones, said rotary drying device being fitted to said partition panel separating said secondary and tertiary zones, said blower unit and said rotary drying device being removable units combined with the respective partition panels.

* * * * *